US008481898B2

(12) United States Patent
Parker

(10) Patent No.: US 8,481,898 B2
(45) Date of Patent: Jul. 9, 2013

(54) SELF REGULATING ELECTRIC HEATERS

(76) Inventor: Robert Parker, Bend, OR (US)

( * ) Notice: Subject to any disclaimer, the term of this patent is extended or adjusted under 35 U.S.C. 154(b) by 0 days.

(21) Appl. No.: 13/117,904

(22) Filed: May 27, 2011

(65) Prior Publication Data

US 2011/0297665 A1 Dec. 8, 2011

Related U.S. Application Data

(60) Provisional application No. 61/351,573, filed on Jun. 4, 2010, provisional application No. 61/416,246, filed on Nov. 22, 2010.

(51) Int. Cl.
*H05B 3/16* (2006.01)

(52) U.S. Cl.
USPC ..... 219/543; 252/511; 219/484; 219/494; 219/504; 219/538

(58) Field of Classification Search
USPC ..... 219/482, 494, 504, 505, 538, 540, 219/542–544, 548; 252/511; 392/306, 341, 392/441–464, 502
See application file for complete search history.

(56) References Cited

U.S. PATENT DOCUMENTS

| | | | | |
|---|---|---|---|---|
| 5,854,471 | A * | 12/1998 | Tadokoro et al. | 219/540 |
| 5,993,698 | A * | 11/1999 | Frentzel et al. | 252/511 |
| 2002/0011477 | A1* | 1/2002 | Jones et al. | 219/219 |
| 2006/0054616 | A1* | 3/2006 | Ptasienski et al. | 219/543 |

FOREIGN PATENT DOCUMENTS

| | | | |
|---|---|---|---|
| JP | 10183039 | A | 7/1998 |
| JP | 2000086872 | A | 3/2000 |
| JP | 2000223244 | A | 8/2000 |
| JP | 2005150069 | A | 6/2005 |

OTHER PUBLICATIONS

ISA Korea, International Search Report of PCT/US2011/039160, Feb. 9, 2012, WIPO, 5 pages.

* cited by examiner

*Primary Examiner* — Brian Jennison
(74) *Attorney, Agent, or Firm* — Alleman Hall McCoy Russell & Tuttle LLP

(57) ABSTRACT

Systems and methods for PTC materials are described. In one example, a PTC constant wattage heater provides two or more self regulating heating modes. The PTC constant wattage heater may provide self regulating temperature and current control at lower expense.

16 Claims, 11 Drawing Sheets

SELF REGULATING ELECTRIC HEATERS

CROSS-REFERENCE TO RELATED APPLICATIONS

This application claims priority from U.S. Provisional Patent Application Ser. No. 61/351,573, filed Jun. 4, 2010 and entitled PRINTED ELECTRICAL DEVICES USING POSITIVE THERMAL COEFFICIENT OF ELECTRICALLY CONDUCTIVE THICK FILM INKS TO PRODUCE VARIOUS HEATING AND CONTROLLING DEVICES, and from U.S. Provisional Patent Application Ser. No. 61/416,246, filed Nov. 22, 2010 and entitled SELF REGULATING ELECTRIC HEATERS, the entirety of each of which are hereby incorporated herein by reference for all intents and purposes.

BACKGROUND/SUMMARY

Constant wattage heaters are used for many applications such as under floor heaters, home zone heaters, mirror defoggers, water heaters, in appliances, incubators, food warmers, aquarium heaters, etc. In one example, constant wattage heating is provided along a length of the heater by providing heating zones made of heating elements that are electrically coupled in parallel. Constant wattage heaters consume electrical energy at a substantially constant rate when a constant voltage is applied to the heaters. Further, the impedance or resistance of constant wattage heaters remains substantially constant during operation. However, such heaters may have a number of issues. For example, if insulation is placed over the heaters limiting the heat lost to ambient surroundings, temperatures around the heaters can increase and may possibly cause heater degradation. Such conditions may be especially relevant when large areas are heated, such as for under floor heaters.

A control element like a thermistor, thermocouple, or bimetal switch may be employed to limit the temperature of the heater. However, control elements can add cost and complexity to a simple heater. Further, a controller configured to adjust electrical power delivered to the heater based on the control element may be required to control the heater to a desired temperature. In addition, the possibility of heater control degradation increases as the number of control elements increases. The placement of temperature sensing devices may also be important to ensure desired temperature control because localized insulation or convection may affect heater temperature. One way to provide temperature control for a heater is to position temperature sensors or switches all over the surface of the heater. However, hundreds of sensors, switches, and electric connections linking sensors to a controller may be required to cover the entire heater surface depending on the size of the heater and the extent of the temperature feedback sought.

In some heater applications, the watt density "Q" (watts/$m^2$ or watts/$ft^2$) of a heater may be limited because higher watt densities may result in temperatures that are higher than is desired. Further, in some applications, it may be desirable to have rapid heating so as to bring an assembly or component to some desired temperature in a relatively short period of time instead of waiting to reach some equilibrium temperature. Thus, the diversity of heating requirements between different applications may make it difficult for one heater approach to be applicable to more than a single application.

Another type of heater is a positive temperature coefficient (PTC) heater. Self regulating heaters using PTC materials were pioneered by Raychem Corporation in the 1970's. Carbon based polymer inks and carbon loaded polymers are examples of PTC materials developed for electric heaters and resettable fuses. The application of the PTC materials was severely limited because the PTC material had initial high resistance $10^5 \rightarrow 10^6$ ohms/sq. Further, the materials required very close buss bar spacing and etched buss bars because the material would degrade at high watt densities. Subsequently, other companies including DuPont developed material with lower sheet resistivity of 1500 ohms/sq, but the material would increase in resistance by only three or four times. Therefore, the material lacked properties for effectively limiting current or heating. In addition, the resistance increased gradually as material temperature increased. Thus, a large change in material temperature was required to produce a large change in the resistance of the material. More recently, in U.S. Pat. No. 5,993,698 by Frentzel et al., a new screen printable ink is disclosed that exhibits a large change in ink coating resistance with a relatively small change in ink temperature.

The inventor herein has recognized the above-mentioned disadvantages of PTC and constant wattage heaters and has developed a heater, comprising: a printed or coated PTC material providing a resistance of 20 to 1500 ohms/sq, the resistance increasing three to five orders of magnitude at a threshold temperature, the printed or coated PTC material in thermal communication with a heated area, the resistance of the PTC material responsive to a temperature of the heated area.

By constructing a heater comprising PTC material with a low resistance below a trigger temperature of the PTC material and a resistance that is three to five orders of magnitude above the trigger temperature, it may be possible to provide heaters and current limiting devices that overcome limitations of materials having higher levels of resistance. Further, a heater or current limiting device comprising PTC material and a constant wattage heating element can provide improved self regulating heater control. For example, the PTC material can provide rapid heating and current regulation while the constant wattage heater can provide uniform heating and power utilization over a large heating area. In one example, a uniform coating of PTC ink traces can be configured to link two portions of a constant wattage heating element. If the constant wattage heating element temperature increases to a threshold temperature that initiates or triggers a threshold change in resistance of the uniform coating of PTC ink, current flow through the constant wattage heating element is limited via the PTC ink trace-. Similarly, if a voltage applied to the constant wattage heater is inadvertently increased to a level where current though the PTC ink trace increases to a level heating the PTC ink to a trigger temperature, current flow may be restricted by the PTC material such that degradation of the constant wattage heater may be limited. In this way, temperature and current flow through a heater may be controlled without a complex controller and control elements so that heater reliability can be increased while system complexity may be reduced.

The present description may provide several advantages. In particular, the present description provides for heater regulation absent a controller, controller sensors, and controller actuators. Further, the present description may reduce system cost since the heaters and current control devices may be fabricated relatively simply. Further still, a large variety of heating devices having different heating properties may be constructed according to the present description.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
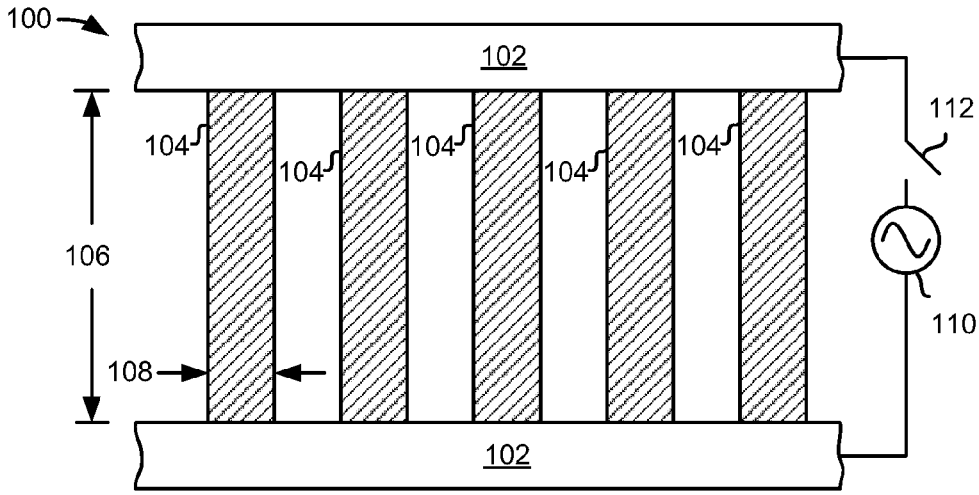
PRIOR ART FIG. 1
FIG. 1 shows an example of a conventional constant wattage heater.
Figure 2:
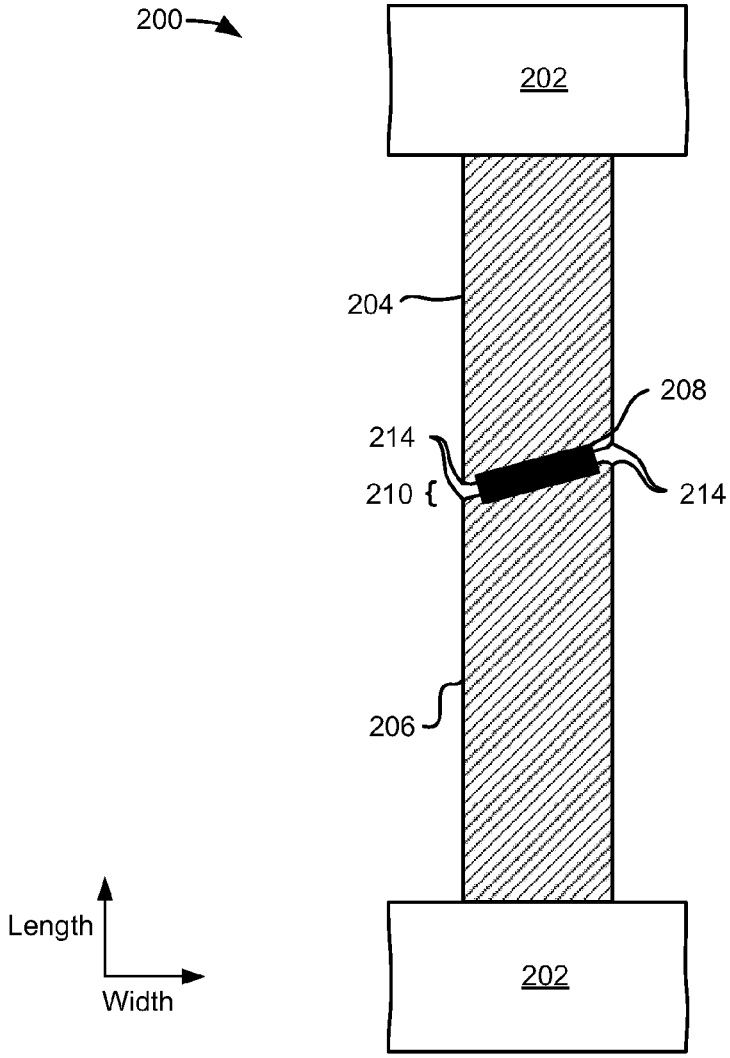
FIG. 2 shows an example of a PTC constant wattage heater.
Figure 3:
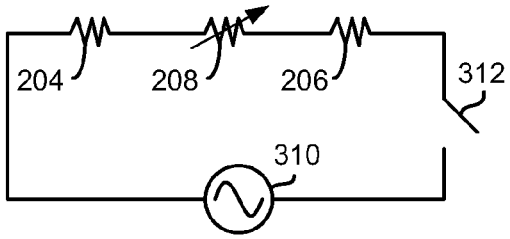
FIG. 3 shows a schematic circuit diagram of the example of FIG. 2.
Figure 15A:
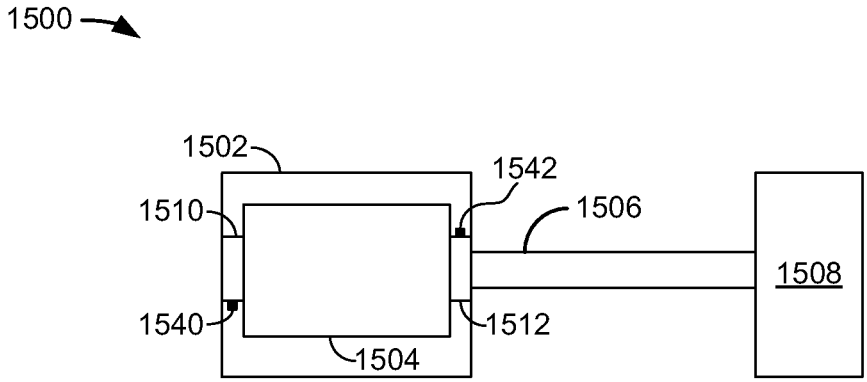
FIG. 15A shows a PTC current limiting device in a system including an electric motor.
Figure 15B:
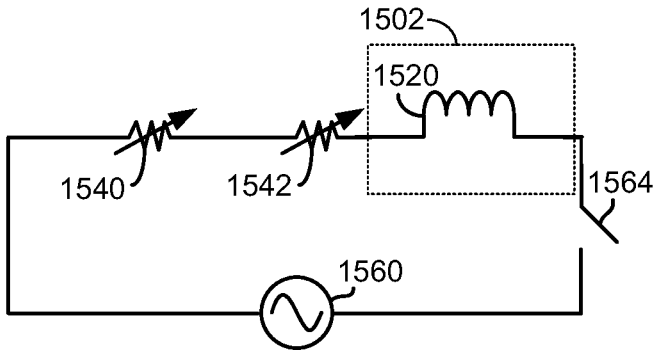
FIG. 15B shows an example electrical circuit for a current limiting device when applied to an electric motor.
Figure 16:
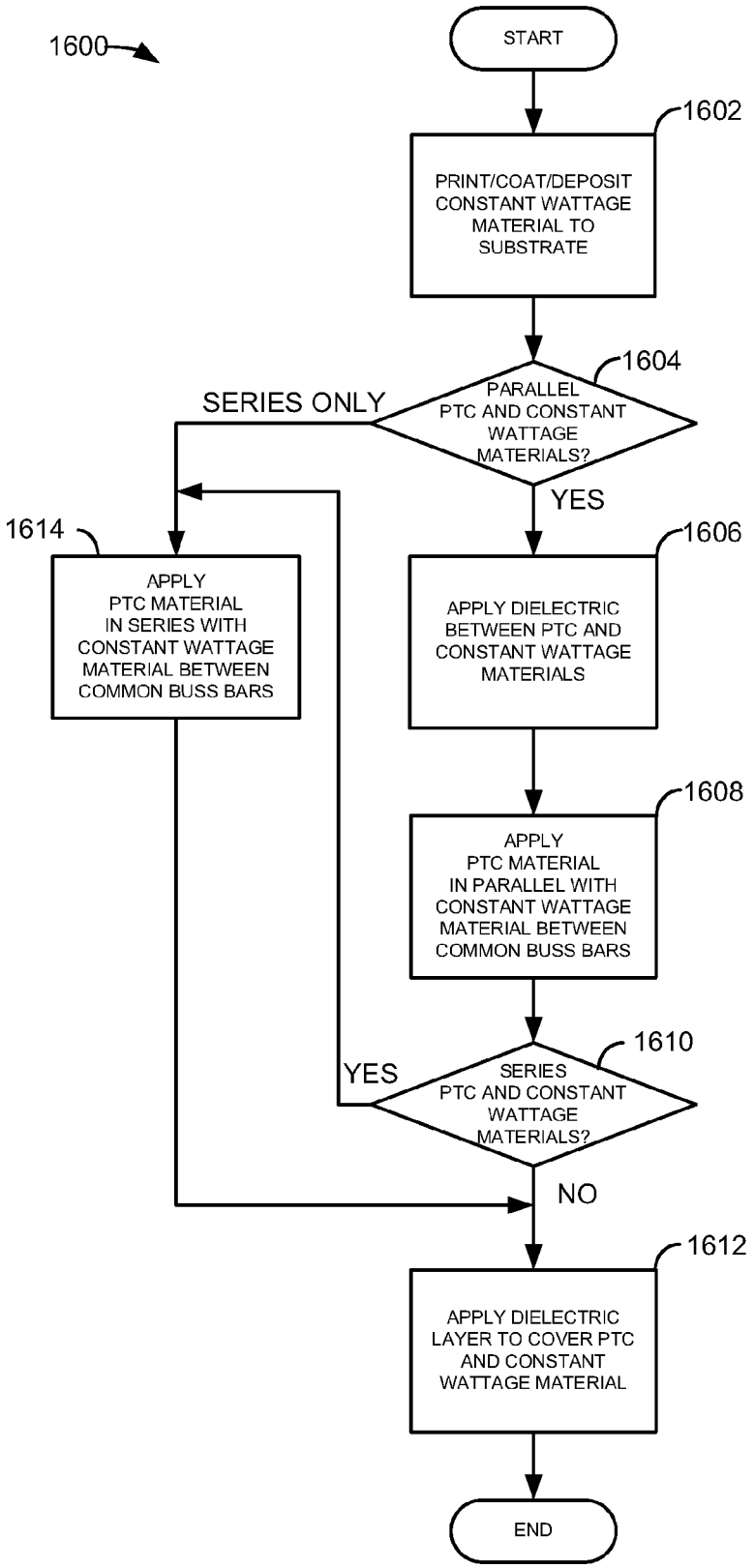
FIG. 16 shows an example method for manufacturing or fabricating a PTC constant wattage heater or current limiting device.
Figure 17:
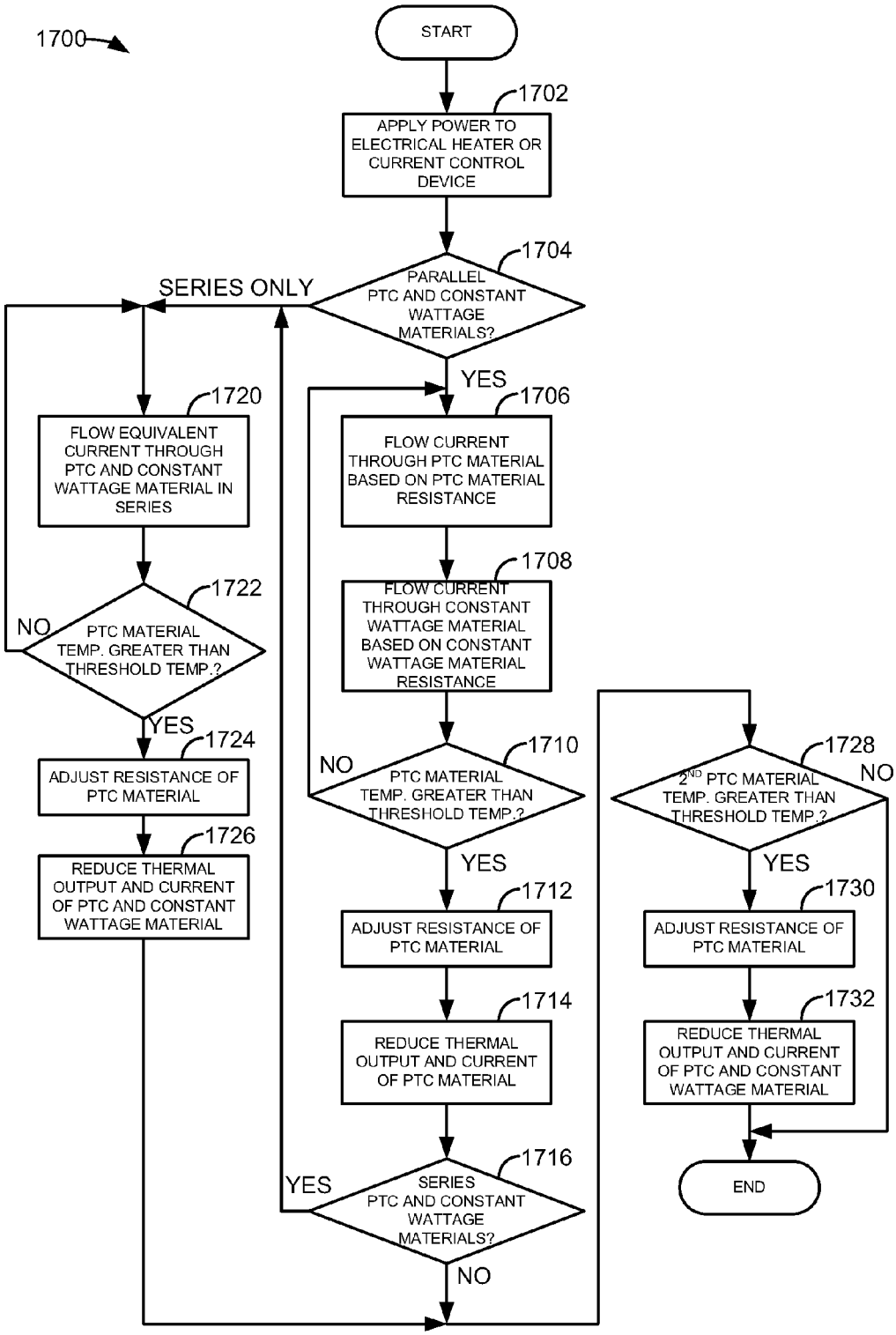
FIG. 17 shows an example method for operating a PTC constant wattage heater or current limiting device.

The present description is related to self regulating heaters and current control devices. FIG. 1 shows a prior art constant wattage heater that is comprised of a plurality of heating elements. FIGS. 2 and 3 show an example of heating elements and approximate equivalent circuit that is comprised of PTC material and two constant wattage heating elements. FIGS. 4-14 show various examples and equivalent electrical circuits for PTC constant wattage heaters that have different operating characteristics for different types of applications. FIGS. 15A and 15B show an example system including a current limiting device. FIGS. 16 and 17 shows an example method for manufacturing and operating the thermal and current limiting devices described herein.

Recently new conductive screen printable stable inks have been developed that have unique properties. These inks can be formulated in such a manner that below the trigger or PTC onset design temperature, their sheet resistivity can be as low as 20 ohms per square. The PTC material threshold or trigger temperature may be expressed as a temperature at which the resistance of the PTC material changes by more than an order of magnitude. Thus, a trigger temperature of a PTC device is a temperature at which the resistance of the PTC device changes by more than an order of magnitude. The PTC onset or trigger temperature can be varied over a wide range of temperatures using very sharp melting polymers. For example, the PTC trigger temperature can be designed to be within a range of 1° C.-100° C. Further, the PTC material can increase resistance by as much as 4-5 orders of magnitude. Thus, at the PTC trigger temperature, the PTC material can provide an effective current limit function. The manufacturer-Engineered Conductive Materials Inc. LLC of Delaware, Ohio, has provided the following data in table 1 for a conductive ink with a trigger temperature of about 70° C. The inventor herein has recognized that the properties (e.g., the change in resistance of the ink) of the ink may be particularly useful for improving heater designs. In addition, the heating and current limiting properties also enable heaters to be designed as thermal control elements and current limited resettable fuses.

From inspection of table 1, it can be seen that an enormous change in resistance at or near the trigger temperature occurs. The ink as described in table 1 has a sheet resistivity of 40 ohms/sq. when printed to a dry thickness of approximately 0.0005 inches. Consequently, the ink may be incorporated into a circuit such that the ink has little effect on circuit operation until the trigger or threshold temperature is reached. At or near the trigger temperature, the ink may be applied to control circuit operation.

TABLE 1

| | Temp. (in C.) | | | | | | | | | |
|---|---|---|---|---|---|---|---|---|---|---|
| | Room Temp | 30° | 35° | 40° | 45° | 50° | 55° | 60° | 65° | 70° |
| % increase or ratio (resistance) | 1 | 1.21 | 1.34 | 1.5 | 2 | 2.88 | 4.5 | 10 | 80 | $10^5$-$10^8$ |

The concepts outlined herein for self regulating heaters are intended to exploit the recent availability of inks or coatings that have low resistance or that are highly conductive PTC materials having sharp trigger temperatures. Such inks or coatings can be designed to sharply increase their resistance at any given trigger temperature (e.g., 3° C.-100° C.) by 4 or 5 orders of magnitude.

Constant wattage heaters in series with a PTC control element can be used over a wide range of watt densities and conditions. But depending on the application, PTC devices may work best at lower watt densities (5 watts/in$^2$ or less) and when temperature uniformity is required. Interdigitated offset superimposed heaters disclosed herein may be used for de-icing of airplane wings, helicopter blades and other uses where high watt density or very localized heat is desired or where very rapid heating is desired. It should also be noted that while the devices described herein are designed to be heaters, because of the great sensitivity to ambient conditions, the current applied to heat the devices can be a basis for sensing wind flow, fluid levels, dry levels, solar radiation heating etc. PTC heaters may also be applied for over-temperature control or resettable thermal regulators. Additionally, the heaters disclosed herein may be applied for resettable over-current protection or for resettable fuses.

Referring now to FIG. 1, typical construction of a printed constant wattage heater 100 is shown. Buss bars 102 are fabricated from very conductive materials such as copper or silver and are in electrical contact or are electrically coupled to printed carbon heater elements 104. A voltage 110 is applied to carbon heater elements 104 via buss bars 102 to provide Joulean heating when switch 112 is closed. Heater 100 is comprised of printed carbon, but heaters comprised of other materials such as metal vapor deposited and/or sputtered conductors may also be constructed. In this example, 110 volts AC is applied to heater 100. However, in other examples DC may be applied to heater 100. Carbon elements 104 have a length 106 of 10.5 inches and a width 108 of 0.25 inches.

The measured resistance for each carbon element is 23,000 ohms/bar. The resistivity can be determined as follows:

$$R = \rho\frac{L}{W} \text{ or } \rho = \frac{RW}{L}$$

Where R is the resistance in ohms, L is the distance between buss bars 102, W is the width of each heater element in inches, and p is the sheet resistivity in ohms/sq. Applying the known resistance and heater dimensions the resistivity equation yields:

$$\rho = \frac{23{,}000\cdot(0.25)}{10.5} \text{ or } 550\frac{\Omega}{sq}$$

The watt density can be determined according to the equation:

$$Q = \frac{V^2}{L^2\rho}$$

Where Q is the watt density and V is the applied voltage. Applying the known voltage the watt density equation yields:

$$Q = \frac{(110)^2}{(10.5)^2\cdot 550} = 0.2\frac{\text{watts}}{\text{in}^2}$$

If a PTC heater is substituted for the constant wattage heater in the heater arrangement shown in FIG. 1, a heated line would quickly develop within the PTC material. In particular, as current flows through the PTC material, some small increase in resistance of the PTC material would cause a portion of the heater element to get warmer as compared to another portion of the heater. As the temperature of the PTC material increases to near the trigger temperature, a small segment or heated line is formed across the PTC material so that only a small part of the heater is at an elevated temperature and the surrounding heater material is cold. Consequently, the entire voltage 110 is impressed across a very narrow heated region of the PTC heater. A voltage potential across a narrow region of the heating element may cause arcing and voltage breakdown at the heated line. Due to manufacturing variation, the initial PTC resistance can vary substantially at low temperatures (e.g., below the trigger temperature) thereby, altering the watt density of the PTC material and subsequently altering the heating. On the other hand, constant wattage heaters comprises of carbon resistors and metallic resistor materials show little change in resistance with temperature and are quite stable.

Referring now to FIG. 2, a heater that includes PTC material and constant wattage heating elements is shown. The heater 200 shown in FIG. 2 and other heaters shown throughout the description may overcome the deficiencies of PTC heaters and constant wattage heaters that are constructed solely of PTC material or constant wattage material.

Heater 200 includes buss bars 202, a uniform coating of printed low resistance PTC material 208, and two constant wattage heating elements or heaters 204 and 206. As illustrated, a heater may be comprised of one or more heater elements. PTC material 206 is placed electrically in series with the more resistive constant wattage heaters 204 and 206. And, the PTC material resistance is lower than the constant wattage heaters resistance when the PTC material is at a temperature below the trigger temperature of the PTC material. However, the PTC material resistance is higher than the constant wattage heater resistance when the PTC material is at a temperature higher than the trigger temperature of the PTC material. In one example, PTC printed zone 210 is 0.10 inches wide, although the width is not critical as long as the PTC printed zone 210 is 10% or less of the heater length. The PTC printed zone 210 can be normal to the direction of the current flow, or it can be at some angle as shown in FIG. 2. The advantage of placing the PTC printed zone at an angle is that the path length is longer so the resistance is smaller. End corners 214 of constant wattage heaters 204 and 206 that are near PTC printed zone 210 are rounded to prevent high voltage stress. PTC material 208 can be printed on each constant wattage element 204 and 206 of a heater so that the equivalent of a temperature controller comprising thousands of control elements is incorporated into a heater.

In some examples, the PTC material has a sheet resistivity of from 10%-20% of the constant wattage heater resistivity. Therefore, the PTC segment will be cooler than the adjoining constant wattage neighboring material when current is applied to the heater.

If the heater is thermally insulated, and if a temperature of the heater increases due to conditions around the heater, the heater can approach the trigger temperature of the PTC material (e.g., the temperature of the heater approaches a temperature where a resistance of the PTC changes by an order of magnitude) where the resistance of the PTC material will increase, thereby reducing current flow though the heater and the possibility of insulation degradation. In this way, the PTC material acts as an automatic feedback system and regulates the current flowing through the constant wattage heating elements. Further, the constant wattage elements 204 and 206 act as part of the electrical load and reduce the possibility of arching and voltage breakdown. Essentially, when any part of voltage applied to the heater appears across PTC printed zone 210, current flow through the heater is limited.

An experiment was conducted where the resistance of the heater was 23,000 ohms. Upon heating to the trigger temperature (≈70° C.), the resistance increased to 750,000 ohms. The change in resistance increased approximately 30 times greater than the initial resistance of the heater. However, because the heater is a feedback system, the heater temperature did not increase beyond 70° C. The resistance of the PTC material 208 increased so as to limit current flow through the constant wattage heating elements of the heater. Accordingly, the heater stayed at the design temperature while the design voltage was applied.

It should be noted that a plurality of PTC printed zones 210 may be incorporated along the length of heater 200 to reduce to possibility of localized heating. Thus, a plurality of constant wattage heating elements may be electrically coupled in series via PTC printed zones between buss bars.

Referring now to FIG. 3, an approximate equivalent circuit of heater element 200 from FIG. 2 is shown. Fixed value resistor 204 represents one constant wattage heater segment 204 in FIG. 2. Variable value resistor 208 represents resistance of a PTC printed zone 210 of FIG. 2. Fixed resistor 206 represents a second constant wattage heater segment 206 of FIG. 2. Voltage from supply 310 is applied across resistors 204-208 when switch 312 is closed.

Variable resistor 208 exhibits a low resistance during conditions where a temperature of the heater is below the trigger temperature of the PTC material integrated in the heater. Resistors 204 and 206 have a constant level of resistance and convert electrical energy into heat. Further, since resistors 204 and 206 have higher resistance than variable resistor 208 at temperatures lower than the trigger temperature of the PTC material, a majority of voltage drop occurs across resistors 204 and 206 at temperatures below the PTC material trigger temperature. As such, the amount of current flowing through heater element 200 is substantially controlled by the resistance of the constant wattage heaters. Thus, the constant wattage heaters limit or control current flow through heater 200 to a greater extent than the PTC material in a first mode when heater temperature is less than a trigger or threshold temperature of the PTC material.

On the other hand, variable resistor 208 exhibits a higher resistance during conditions where a temperature of the heater approaches a trigger or threshold temperature of the PTC material integrated into the heater. The PTC material has a resistance that is much greater than the constant wattage heater when the PTC material is exposed to a temperature near the trigger temperature of the PTC material. Consequently, a majority of the voltage drop occurs across the variable resistor 208 and a substantial portion of current flowing through the heater and constant wattage elements 204 and 206 is limited via the PTC material. Therefore, the PTC material limits or controls current flow through heater 200 to a greater extent than the constant wattage heaters in a second mode when heater temperature is near or above a trigger or threshold temperature of the PTC material.

Figure 4A:
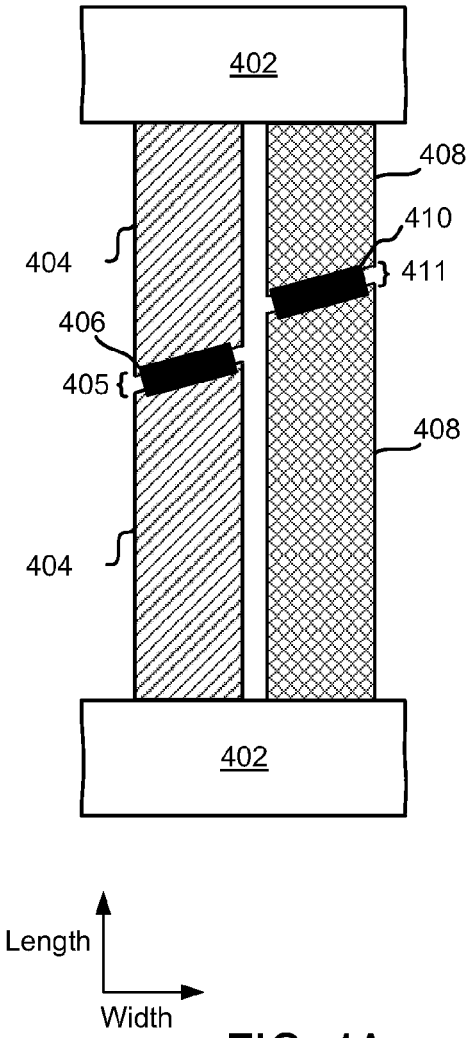
FIGS. 4A-4B show another example of a PTC constant wattage heater.
Figure 4B:
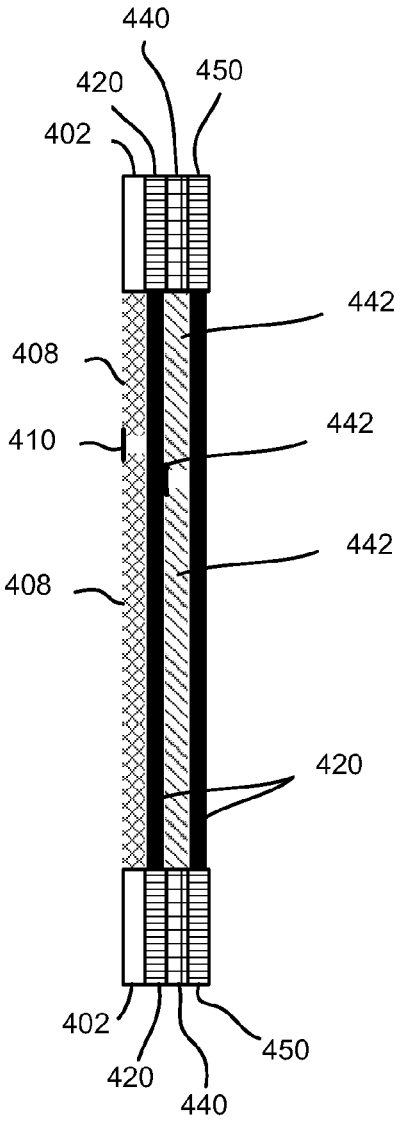

Referring now to FIGS. 4A and 4B, another example of PTC constant wattage heaters is shown. FIG. 4A is a plan view of heater 400 and FIG. 4B is an end view of heater 400.

Heater 400 includes bus bars 402, a uniform coating of printed low resistance PTC material 406 and 410, and constant wattage heating elements 404 and 408. Constant wattage heating elements 404 and 408 may be fabricated of similar or different material. PTC elements including PTC material 406 and 410 is placed electrically in series with more resistive constant wattage heaters 404 and 408. The PTC material has a resistance that is lower than the constant wattage heater resistance when the PTC material is at a temperature below the trigger temperature of the PTC material. The PTC material resistance is higher than the constant wattage heater resistance when the PTC material is at a temperature higher than the trigger temperature of the PTC material. In one example, the PTC material resistance may be less than 20% of the constant wattage heater resistance when a temperature of the PTC material is less than a trigger or threshold temperature of the PTC material. Further, the trigger temperature of PTC material 406 may be different than the trigger temperature of material 410. PTC material 406 and 410 spans gaps 405 and 411 in constant wattage heaters 404 and 408. In the present example, gaps 405 and 411 are shown offset from each other, but gaps 405 and 411 may be aligned in other examples.

FIG. 4B shows an edge view of heater 400. Buss bars 402 are in electrical communication with constant wattage heaters 408. PTC material 410 is in electrical series with constant wattage heaters 408. Dielectric coating or laminate 420 electrically insulates constant wattage heaters 408 and 442. Insulators 420 electrically insulate buss bars 402 from buss bars 440 so that constant wattage heaters 408 may be activated at different times than constant wattage heaters 442. In other examples, a single pair of buss bars may be shared between constant wattage heaters 408 and constant wattage heaters 442 so that the constant wattage heaters may be simultaneously activated. Insulators 450 electrically insulate buss bars 440 from material surrounding heater 400.

In this way, several PTC heaters may be combined so as to provide different amounts of thermal output. For example, activating a first PTC heater may provide a first level of thermal output. Activating a second PTC heater may provide a second level of thermal output that is 20% greater than the first level of thermal output. Further, the first and second PTC heaters may be simultaneously activated to provide more than double the thermal output of the first heaters. In addition, there may be provided different PTC materials electrically coupling different constant wattage heaters such that the different PTC materials regulate the different constant wattage heaters to different temperatures. For example, one heater may include PTC material that regulates heater temperature to 20° C. while another heater includes PTC material that regulates heater temperature to 30° C. and so on. Thus, it is possible to provide a range or plurality of temperatures via a single heater including a plurality of constant wattage heaters and PTC elements via selectively applying electrical power to different PTC heaters including different PTC materials that include different threshold or trigger temperatures. The PTC material and the constant wattage heaters of one heating element of the heater may be electrically insulated from the PTC material and constant wattage heaters of a second heating element of the heater.

Figure 5:
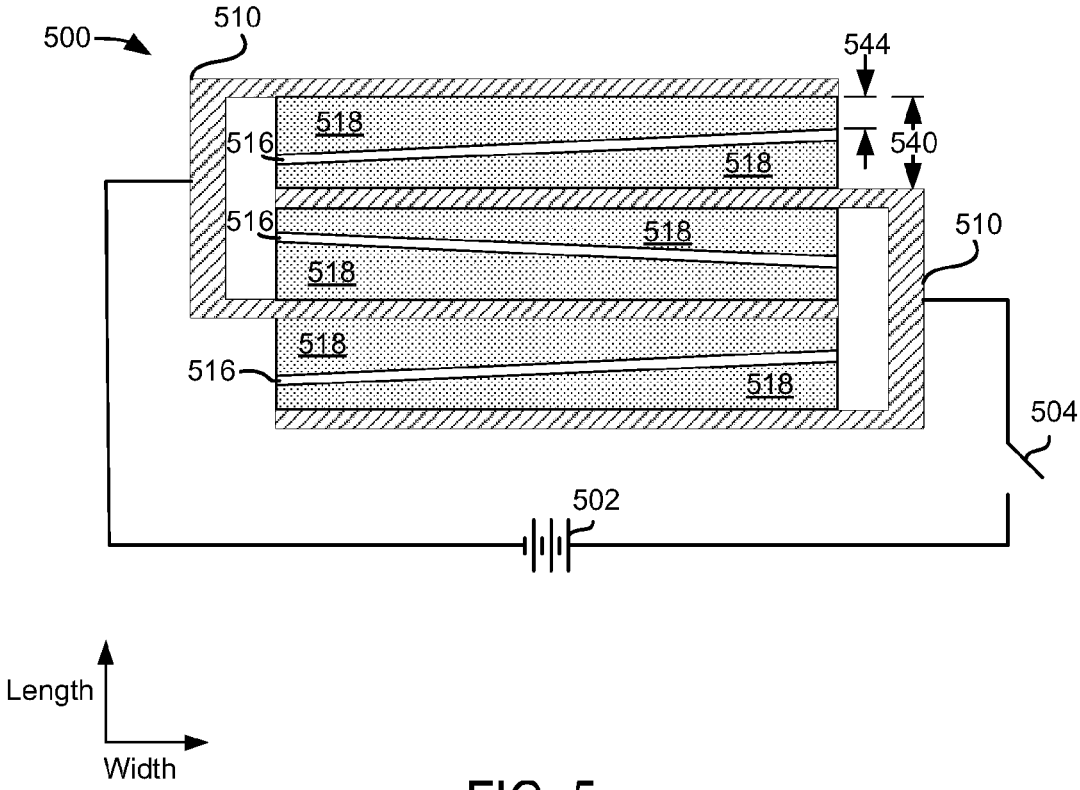
FIG. 5 shows an example of a carbon constant wattage PTC heater.

Referring now to FIG. 5, an example of a carbon constant wattage PTC heater is shown. Some applications may require higher watt densities. Carbon is one material that may provide heating at higher watt densities. Heater 500 is shown in a plan view indicating directions of heater length and width, but the heater also has a depth extending into the figure.

Heater 500 is comprised of constant wattage carbon based heaters 518, layers of PTC material 516, and silver or metallic buss bars 510. Constant wattage carbon based heaters 518 are interleaved with PTC material 516 between U shaped buss bars 510. The PTC material is shown again in a diagonal orientation between two constant wattage carbon based heaters. The diagonal orientation allows the PTC material to sense more area. Power supply 502 supplies voltage and current to buss bars 510 when switch 504 is in a closed state. In this example, each of buss bars 510 have prongs that extend and contact constant wattage carbon based heaters 518. Buss bars 510 may be coupled to carbon heaters 518 and carbon heaters 518 may be coupled to PTC material 516 so that heater 500 is an integrated assembly that resists separation of elements. Buss bars 510 are arranged such that positive and negative poles alternate from the top to bottom of heater 500. Therefore, each prong of each U shaped buss bar is part of two heating circuits that are comprised of two constant wattage carbon based heaters 518 and two layers of PTC material 516. PTC material 516 is in electrical and physical contact with constant wattage carbon based heaters 518. Further, PTC material 516 is in thermal communication with carbon based heaters 518. Heater 500 operates and has an equivalent circuit similar to the circuit shown in FIG. 3, except that heater 500 includes three heating elements comprised of PTC material 516 and constant wattage carbon based heaters 518. In addition, the heater shown in FIG. 5 can be combined with another heater similar to the heater shown in FIG. 5 by superimposing one heater on the other with a dielectric layer between the heaters.

Buss bar spacing may be determined according to the following example. Assuming a desired watt density of 10 watts/in$^2$, an applied voltage of 12 volts at 502, and carbon with a sheet resistance of over 250 ohms/sq the Buss Bar spacing 540 becomes:

$$L = \sqrt{\frac{144}{(250)\cdot 10}} = \frac{12}{50} = 0.24 \text{ inches}$$

Therefore, the PTC width can be 0.04 inches or ⅙ of the width 544.

Figure 6:
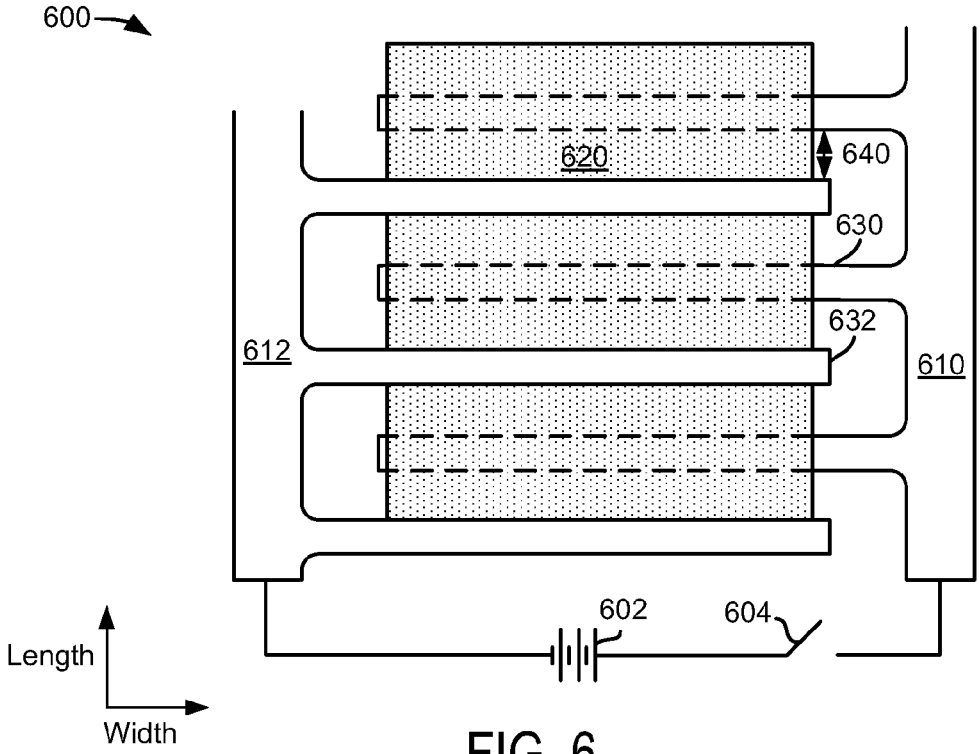
FIG. 6 shows an example of a PTC heater utilizing an interdigitated buss bar design.

Referring now to FIG. 6, a PTC heater with an interdigitated buss bar is shown. Heater 600 is shown in a plan view indicating directions of heater length and width, but the heater also has a depth extending into the figure. The interdigitated buss bar of FIGS. 5 and 6 allows PTC material to be used as a heating element in the absence of a constant wattage heater. The interdigitated buss bars reduce the possibility of heat lines via reducing length between buss bars.

Heater 600 includes a first buss bar 610 printed with silver conductive ink, second buss bar 612 printed with silver conductive ink, PTC material 620 may be printed or deposited on a substrate. PTC material is shown interleaved between fingers 630 and 632 of interdigitated buss bars 610 and 612. Individual heating elements are constructed between each pair of interdigitated buss bar fingers 630 and 632 via current flowing between fingers through PTC material 620. The heater of FIG. 6 has an equivalent circuit comprising a variable resistor electrically coupled in parallel with power source 602. Voltage develops between the interdigitated buss bar fingers 630 and 632 when switch 604 is in a closed state. Consequently, current may flow through PTC material 620 responsive to the temperature of the PTC material.

PTC material 620 provides thermal energy related to the current flowing through the PTC material. Therefore, when a temperature of the PTC material is less than the trigger temperature of the PTC material, a higher rate of heat is output since the resistance of the PTC material is low. The resistance of the PTC material increases when the PTC material reaches a trigger temperature and the rate of heat output by heater 600 decreases. The increasing resistance of the PTC material reduces current flow through the PTC material. The PTC material remains near the trigger temperature allowing a temperature of heater 600 to stabilize. In this way, a heater can be designed based on the characteristics of PTC material to provide a selected heating temperature that is determined by the PTC material.

Heater 600 has an approximate equivalent circuit of a group or plurality of variable resistors in electrical parallel with a power source. Thus, if one of the PTC elements or variable resistors representing the PTC elements of the plurality of resistors reaches the PTC trigger temperature, current may be restricted through the single PTC element or variable resistor equivalent while the other PTC elements or variable resistors continue to conduct and generate heat. If all the PTC elements between the buss bars reach the PTC trigger temperature, then current is restricted through the entire heater.

In one example where the PTC material is highly conductive (e.g., 20 ohms/sq), the PTC material allows for wider buss bar spacing according to equation:

$$L = K\sqrt{\frac{1}{\rho}}$$

Where K is a constant, L is a distance between buss bars, and ρ is the sheet resistivity in ohms/sq.

When less conductive PTC materials (e.g., 10,000 ohms/sq) are placed within interdigitated buss bars, buss bar spacing 640 should be much closer and considerably more silver should be used for an interdigitated buss bar heater scheme. For example, buss bars supplying electrical power to less conductive PTC material may have to be spaced closer than 0.01 inches apart to avoid heat lines. However, when highly conductive PTC material with a resistance of 20 to 1500 ohms/sq as described herein is provided in heaters and current control devices, buss bar spacing of 0.15 inches or more can be provided. Further, highly conductive PTC material can reduce the amount of silver in buss bars supplying electrical power to the PTC material because of the higher conductivity of the PTC material. The buss bar spacing should be positioned close enough to reduced the possibility of forming heated lines between buss bars. However, the spacing of buss bars can be adjusted depending on the substrate that the heater is bonded on. For example, a good temperature conductor such as aluminum would widen the heating line. On the other hand, silver buss bars 610 and 612 have to be wide enough to accommodate inrush of surge current. In some examples, cold spots may form on the heating surface of an interdigatated buss bar design causing non-uniform heating. Such conditions may be overcome and uniform heating may be provided by superimposing another interdigitated PTC heater on the first interdigitated PTC heater. In some examples, dielectric material may be placed between two overlapping interdigitated PTC heaters. If such a heater arrangement is constructed, the hotter areas of one heater should be placed over the cooler areas of the other heater so as to provide heating uniformity. The individual heating elements of heater 600 share the main buss bars 610 and 612 to reduce the use of silver.

Figure 7A:
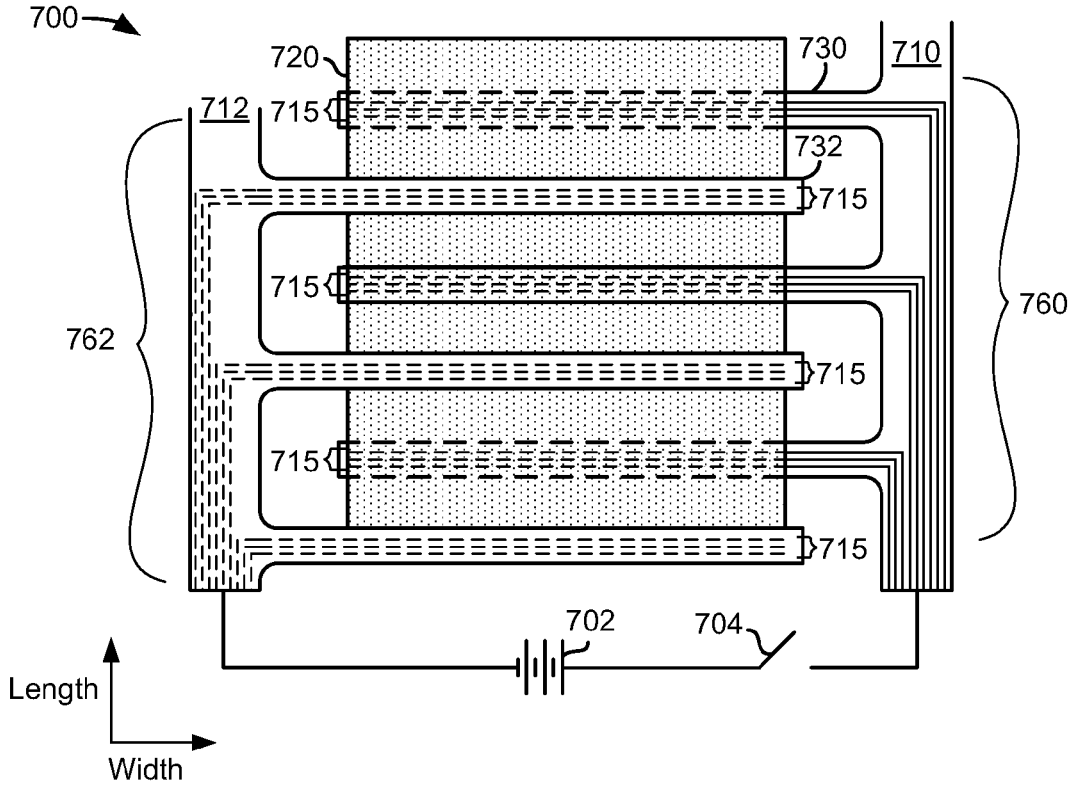
FIGS. 7A-7B show an example of a PTC heater with interdigitated buss bars fabricated with copper wire passed through a conductive silver epoxy material.
Figure 7B:
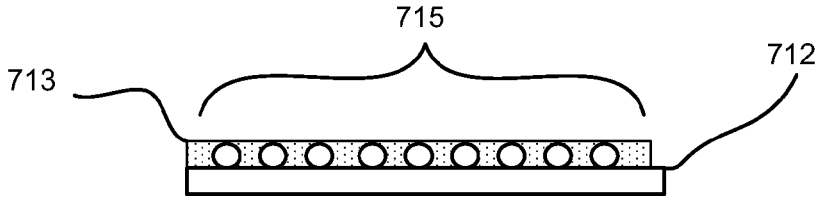

Referring now to FIGS. 7A-7B, a PTC heater comprised of interdigitated buss bars fabricated with copper wire passing through a conductive silver epoxy material is shown. The PTC heater of FIG. 7 is similar in operation and design to the PTC heater of FIG. 6. However, the PTC heater of FIG. 7 provides for increased heater current. In addition, the PTC heater of FIG. 7 has an equivalent circuit and operation similar to the PTC heater of FIG. 6. FIG. 7A is a plan view of heater 700 and FIG. 7B is an end view of finger 730.

Heater 700 includes a first buss bar 710 including copper wire 715 passing through a conductive silver epoxy material 713 and bonded onto a substrate 712 as shown in FIG. 7B. The copper wire may cover buss bar fingers 730 and 732 of buss bars 710 and 712 before ending at the intersection of bus bar fingers 730 and 732 and buss bar trunks 760 and 762. The number of copper conductors in each finger can vary with the width of the finger and the gauge of wire. FIG. 7 shows copper wire 715 covering buss bar fingers 730 and 732 and extending down bus bar trunks 760 and 762. Substrate 712 may fabricated of a thin polyester film 0.005 inches thick or some other dielectric substrate, such as printed circuit board.

Copper wires 715 can form interdigitated buss bars, as shown. A coating or printing 720 of PTC material on a dielectric substrate completes the PTC heater. If thin copper wires (e.g., 0.005-0.010 inches in diameter) are bonded to substrate 712, the cold areas may be small and the conductivity of copper is more than sufficient to accommodate the current inrush. This assembly may be less costly to produce as compared to printed silver since copper wire may be less expensive. The copper also provides for a reliable electrical connection.

Current can flow through material 720 when a voltage from power supply 702 is applied across buss bars 710 and 712 via closing switch 704. Thus, individual circuits arranged in electrical parallel are formed by fingers 730 and 732 with material 720. Current may flow between fingers 730 and 732 through material 720.

In another example, copper wires may be heat bonded to the substrate rather than bonded via epoxy. In addition, some example heaters include buss bars comprised of aluminum strips of a die cut aluminum foil that take the place of the copper conductors illustrated in FIG. 7.

Figure 8A:
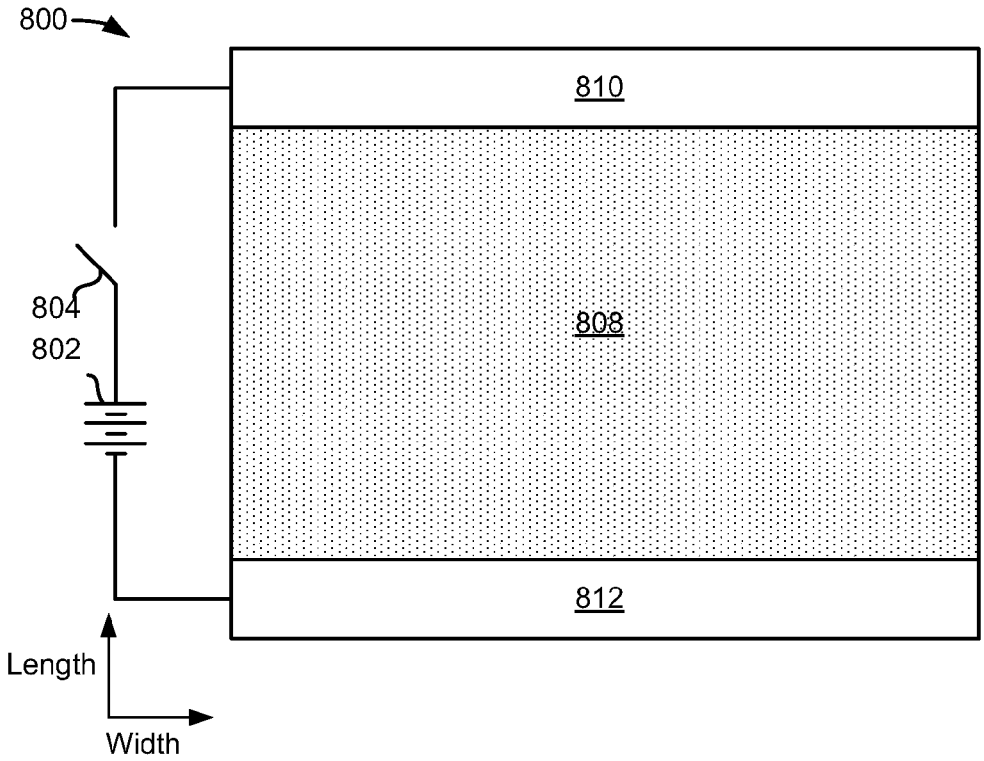
FIGS. 8A-8B show a heater comprising a PTC conductive layer printed, bonded, or coated on a constant wattage heater and in close thermal contact with shared common buss bars.
Figure 8B:
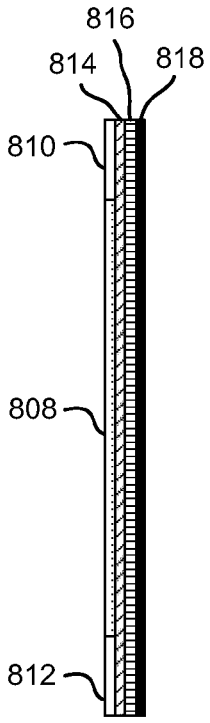
Figure 9:
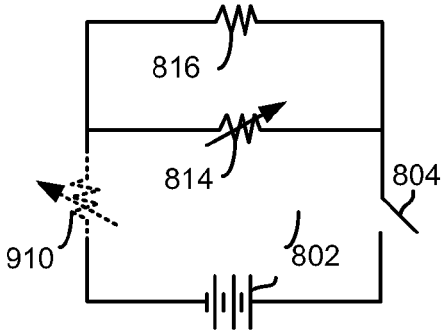
FIG. 9 shows an approximate equivalent electric circuit for the heater shown in FIGS. 8A-8B, a PTC heater is in parallel with the constant wattage heater.

Referring now to FIGS. 8A and 8B, a heater 800 including a PTC conductive layer printed, bonded, or coated on a constant wattage heater and in close thermal contact with shared common buss bars. The PTC heater of FIGS. 8A and 8B provides dual heating operation not available from the example of FIG. 2. FIG. 8A is a plan view of heater 800 and FIG. 8B is an end view of heater 800. The PTC heater of FIGS. 8A and 8B has an equivalent circuit as shown in FIG. 9.

Heater 800 is includes of a dielectric substrate 818, a constant wattage heater 816, a PTC heater 814, dielectric layer or film 808, and buss bars 810 and 812. Dielectric substrate 818 is printed or coated with constant wattage heater 816 which is fabricated from carbon or another conductor. PTC heater 814 is applied over constant wattage heater 816 and is fabricated from a conductor with a sheet conductivity in a range of 2-8 times less conductive than constant wattage heater 816. Thus, PTC heater 814 is in good thermal communication with constant wattage heater 816. Dielectric layer or film 808 coats the sandwiched or layered heater 800. Conductive buss bars 810 and 812 carry voltage and current to PTC heater 814 and constant wattage heater 816 from power supply 802 when switch 804 is in a closed state.

In one example, heater 800 includes a PTC heater layer (e.g., 814 of FIG. 8B) with a much greater conductivity as compared to the constant wattage heater at lower temperatures. The higher conductivity of the PTC heater layer provides for a much higher watt density as compared with the constant wattage heater. As a result, far greater heating rates may be provided by the PTC heater layer as compared to the constant conductivity heater at lower temperatures. Higher wattage densities are useful for rapid defogging of minors and windows. The constant wattage heater continues to heat the heated surface when the PTC temperature is reached, but current flow to the PTC heater is limited. At elevated temperatures or high ambient temperatures, the PTC heater will exhibit a small heated line and essentially only a small part of the substrate will reach the PTC temperature. The example of FIG. 8 has the advantages of simplified construction and buss bars 810 and 812 may be fabricated with small amounts of silver. The layers 808-816 may be printed or coated layers and in some examples a dielectric coating between layers may be provided. In some examples, the constant wattage heater may also be fabricated from vapor deposited metal.

Current can flow through PTC heater material 814 and constant wattage heater material 816 when a voltage from power supply 802 is applied across buss bars 810 and 812 via closing switch 804. Buss bars 810 and 812 may be applied in a layer over top of PTC heater material 814 or between PTC heater material and constant wattage heater 816. Since PTC heater material is highly conductive the resistance of the PTC heater 814 in a direction of heater depth is much less than the resistance of PTC heater 814 in a direction of heater length. Thus, individual electrical elements are arranged in electrical parallel between buss bars 810 and 812. However, if the PTC trigger temperature is reached a bulk of the current flow through heater 800 goes through constant wattage heater 816.

Referring now to FIG. 9, an approximate equivalent electric circuit for heater 800 shown in FIGS. 8A-8B is shown. The PTC heater shown in FIGS. 8A and 8B operates according to the operation of the circuit in FIG. 9. Fixed value resistor 816 represents constant wattage heater layer 816. Variable value resistor 814 represents PTC heater layer 814. Fixed value resistor 816 and variable value resistor 814 are electrically coupled in parallel. A voltage from power source 802 is applied across fixed value resistor 816 and variable value resistor 814 when switch 804 is in a closed state. The voltage causes current to flow in resistor 816 and variable resistor 814.

At heater temperatures lower than the PTC threshold or trigger temperature, the lower conductivity of PTC material 814 causes an amount of current to flow in variable resistor 814 that is greater than the current flowing in fixed resistor 816. Thus, PTC heater 814 and the constant wattage heater 816 are activated simultaneously and a higher current level flows through PTC heater 814 than the constant wattage heater 816 since resistance of PTC heater 814 is less than resistance of constant wattage heater 816 at lower temperatures. Current flowing through PTC heater 814 or variable resistor 814 is reduced to a level lower than current flow through constant wattage heater 816 or fixed resistor 816 when a heater 800 approaches the threshold or trigger temperature of PTC material 814 in the PTC heater.

In this way, the PTC heater provides more thermal energy to the heated surroundings (e.g., a mirrors or glass) as compared to the constant wattage heater when a temperature of heater 800 is less than the threshold or trigger temperature of the PTC material in heater 800. On the other hand, the constant wattage heater may supply more thermal energy to the heated surroundings as compared to the PTC heater after the PTC material of heater 800 reaches its threshold or trigger temperature. As such, heater 800 provides two heating modes. A first heating mode may be transitory in that it occurs when a temperature of heater 800 is less than the threshold or trigger temperature of the PTC material included in heater 800. In the first mode, the constant wattage heater provides a constant heating energy to heater surroundings and the PTC material supplies an elevated amount of heating energy to heater surroundings. In the second mode, the resistance of the PTC material changes by at least by an order of magnitude and may change by five orders of magnitude. Current flow through the PTC material is reduced and the heat energy provided to heater surroundings is reduced to a level below the heating energy that the constant wattage heater supplies to heater surroundings. The first mode can be especially useful to elevate the temperature of mass that is cool. Once the mass reaches the desired temperature, less thermal energy may be required to keep the mass at the higher temperature. Accordingly, the heating energy supplied by the heater can be reduced via limiting current through the PTC material once the mass reaches a desired temperature.

It should also be mentioned that an additional layer of PTC material may be added between one of the buss bars and the parallel combination of the PTC heater and the constant wattage heater. The threshold or trigger temperature of the additional layer of PTC material may be higher than the trigger temperature of the PTC heater that is in parallel with the constant wattage heater. Optional variable resistor 910 represents the additional layer of PTC material placed in series with the constant wattage heater and the PTC heater. The additional layer of PTC material 910 can act to restrict current flow to the constant wattage heater (e.g., fixed resistor 816 and PTC heater 814) during conditions when a temperature of heater 800 is greater than the threshold or trigger temperature of the additional layer of PTC material. Thus, a heater may be provided that initially heats with an elevated thermal output, self regulates to a lower thermal output, and is temperature and current limited with respect to PTC heating and constant wattage heating.

Figure 10A:
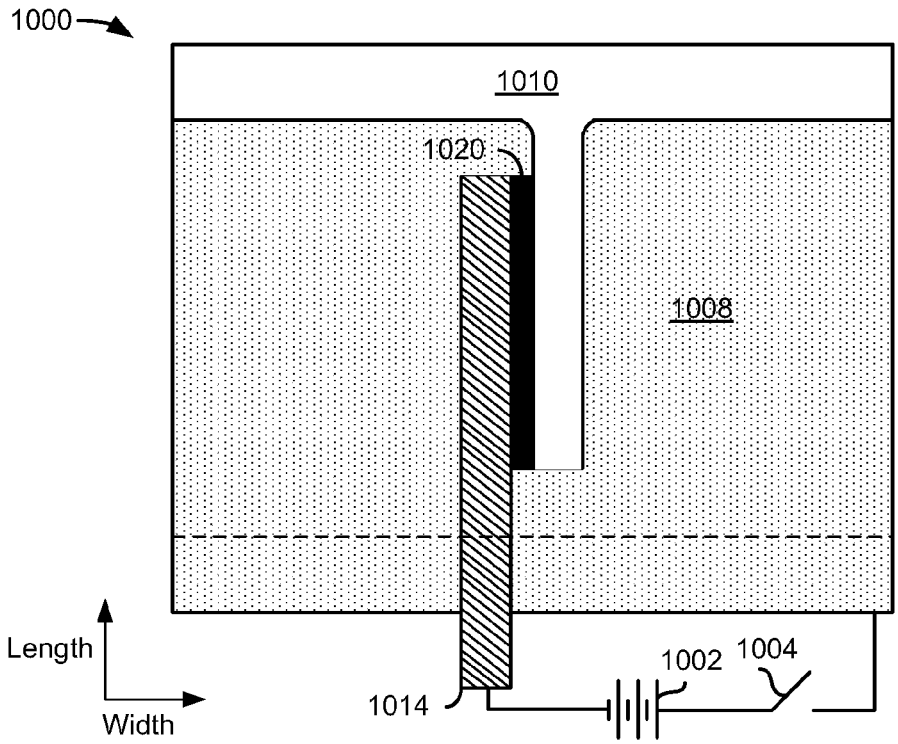
FIGS. 10A-10B show a low resistance PTC heater control element printed or bonded in close thermal contact, and in series with a constant wattage heater.
Figure 10B:
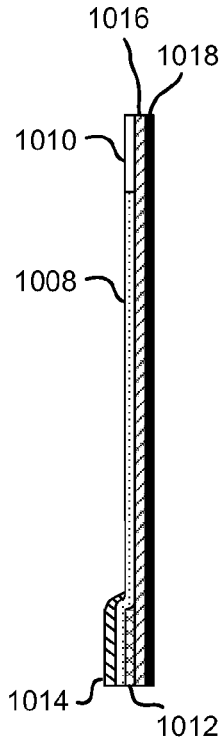
Figure 11:
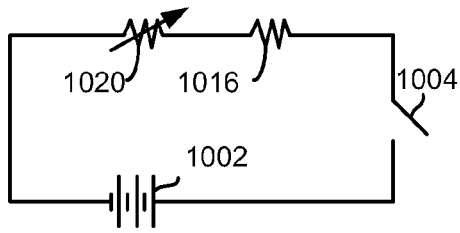
FIG. 11 shows an approximate equivalent electric circuit for the PTC control element in series with a constant wattage heater shown in FIGS. 10A-10B.

Referring now to FIGS. 10A and 10B, a PTC heater 1000 including a dielectric film, a constant wattage heater, a dielectric coating, a PTC element, and buss bars is shown. The PTC heater of FIGS. 10A and 10B provides current limiting to the constant wattage heater during conditions where the PTC material reaches a threshold or trigger temperature of the PTC material. The PTC heater of FIGS. 10A and 10B has an approximate equivalent circuit as shown in FIG. 11. FIG. 10A is a plan view of heater 1000 and FIG. 10B is an end view of heater 1000.

Heater 1000 includes a dielectric film 1018 such as polyester or polyimide that is coated or printed with a constant wattage heater 1016 made with carbon or etched foil. A second dielectric coating 1008 of hot melt adhesive film laminate is bonded of over conductive buss bar 1012 and constant wattage heater 1016. Conductive buss bar 1010 is physically coupled and in electrical communication with constant wattage heater 1016 and PTC material 1020. Thus, conductive buss bar 1010 is in good thermal contact and communication with constant wattage heater 1016 and PTC material 1020. Further, PTC material 1020 is in good thermal contact and communication with constant wattage heater 1016 via lamination or bonding. Conductive buss bar 1014 is physically coupled and in electrical communication with PTC material 1020. Conductive buss bar 1014 and PTC material 1020 may be printed or laminated over constant wattage heater 1016. PTC material 1020 is in electrical series with constant wattage heater 1016. The width of PTC material 1020 may be increased or decreased to vary the series resistance of PTC material. The resistance of PTC material 1020 is lowered when buss bars 1014 and 1010 are spaced closer together.

FIGS. 10A and 10B shows a vertical orientation for buss bars 1010 and 1014 as well as for PTC control element 1020. In other examples, PTC control element 1020 may be a positioned on a diagonal line so that more surface area is in contact with bus bars 1010 and 1014. The PTC heater 1020 acts as a control device to limit the temperature of heater 1000 from increasing above a desired temperature via current limiting feedback based on a temperature of heater 1000.

Referring now to FIG. 11, an approximate equivalent electric circuit for heater 1000 shown in FIGS. 10A-10B is shown. The PTC heater shown in FIGS. 10A and 10B operates according to the operation of the circuit in FIG. 11. Fixed value resistor 1016 represents constant wattage heater layer 1016. Variable value resistor 1020 represents PTC heater layer 1020. Fixed value resistor 1016 and variable value resistor 1020 are electrically coupled in series. A voltage from power source 1002 is applied across the series combination of fixed value resistor 1016 and variable value resistor 1020 when switch 1004 is in a closed state. The voltage causes current to flow into resistor 1016 and variable resistor 1020.

PTC material 1020 or resistor 1020 has a resistance that is much lower that the resistance of constant wattage heater 1016 or resistor 1016 when PTC material 1020 is at temperatures below the trigger or threshold temperature of PTC material 1020. For example, PTC material 1020 or resistor 1020 may have a resistance that is one tenth or less than that of constant wattage heater 1016 or resistor 1016 at heater temperatures less than the PTC threshold or trigger temperature. Therefore, when heater 1000 is at a temperature lower than the trigger temperature of PTC material 1020, an equal amount of current flows through resistors 1020 and 1010, but a higher voltage drop occurs across constant wattage heater 1016 or resistor 1016 than across PTC material 1020 or resistor 1020 and thermal heating is provided by constant wattage heater 1016. However, if a temperature of heater 1000 increases above the trigger temperature of PTC material 1020, the resistance of PTC material increases by an order of magnitude and a higher voltage drop occurs across PTC material 1020 or resistor 1020 than across constant wattage heater 1016 or resistor 1016. Consequently, current flow through constant wattage heater decreases since an equivalent amount of current flows through resistors 1016 and 1020. Thus, heater 1000 is self regulating.

Figure 12A:
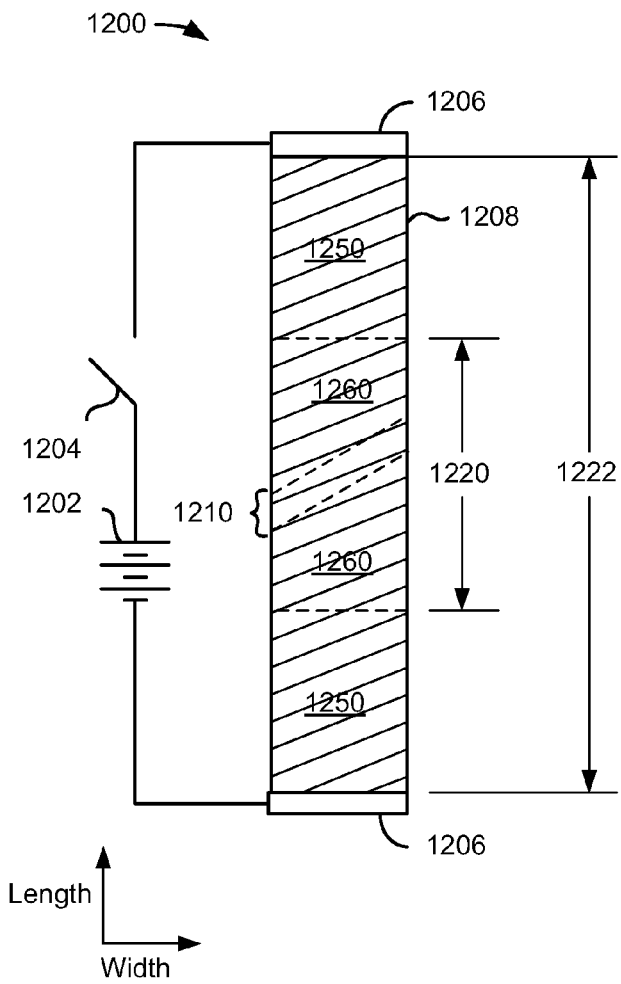
FIGS. 12A-12B show the construction of a constant wattage heater in series with a PTC element and a part of the constant wattage heater coated with a PTC layer to form a series parallel circuit.
Figure 12B:
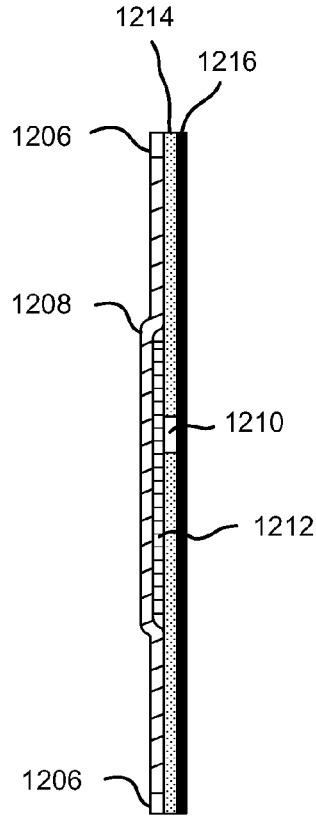
Figure 13:
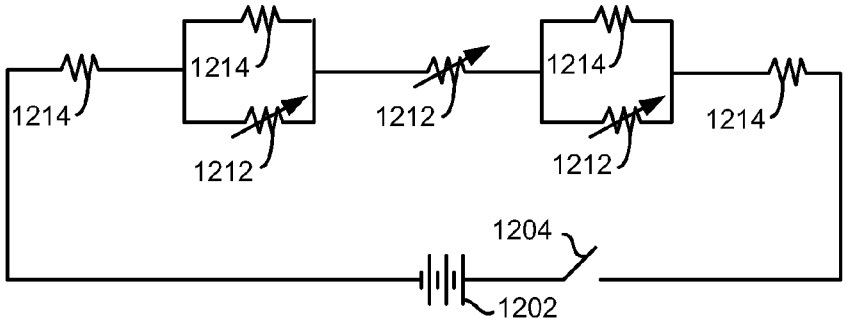
FIG. 13 depicts the series parallel circuit for the heater shown in FIGS. 12A-12B.

Referring now to FIG. 12, a PTC heater 1200 includes a dielectric substrate, a printed constant wattage heater, a conductive PTC heating element, thin film lamination or dielectric protective coating, and buss bars is shown. The PTC heater of FIGS. 12A and 12B provides current limiting to the constant wattage heaters during conditions where the PTC material reaches a threshold or trigger temperature of the PTC material. The PTC heater of FIGS. 12A and 12B has an approximate equivalent circuit as shown in FIG. 13. FIG. 12A is a plan view of heater 1200 and FIG. 12B is an end view of heater 1200.

Heater 1200 includes a dielectric substrate 1216 such as polyester or other films. Printed constant wattage heater 1214 is bonded or coupled to dielectric substrate 1216. Constant wattage heater 1214 may be fabricated from carbon or other suitable material. Constant wattage heater 1214 includes a diagonal gap 1210. Conductive PTC heating element 1212 is printed over diagonal gap 1210. PTC heating element 1212 extends over each side of diagonal gap 1210 for a distance as shown at 1220. Buss bars 1206 are printed and a voltage can be applied to buss bars 1206 over length 1222. Thin film lamination or dielectric protective coating 1208 is applied between buss bars 1206. Thus, constant wattage heater 1214 is coupled to dielectric substrate 1216. Further, PTC heating element 1212 is coupled to constant wattage heater 1214. Further still, dielectric protective coating 1208 is coupled to PTC heating element 1212. Finally, buss bars 1206 are coupled to constant wattage heater 1214. Thus, each layer of PTC heater 1200 is in close thermal communication with the other layers of PTC heater. PTC heating element 1212 acts as a control device to limit the temperature of heater 1200 from increasing above a desired temperature via current limiting feedback based on a temperature of heater 1200. If desired, PTC heating element 1212 may be comprised of a plurality of PTC sections, each section covering a different area of constant wattage heater 1214. For example, an area 1260 bounded by dashed lines representing layers of heater 1200 and a portion of PTC heating element 1212, covers a first portion of constant wattage heater 1214 ending at diagonal gap 1210 may comprise material having 60 ohms/sq. A second area of PTC heating element 1212 covering diagonal gap 1210 may comprise of material having 40 ohms/sq. A third area 1260 bounded by dashed lines representing layers of heater 1200 an a portion of PTC heating element 1212, begins at diagonal gap 1210 and ends before one of buss bars 1206 may comprise material having 60 ohms/sq. Further, each portion or zone of the PTC material may include different PTC threshold or trigger temperatures. In this way, the PTC material may be fabricated to adjust resistance values of an equivalent circuit as shown in FIG. 13 so as to control current flow through heater 1200 during different heater operating conditions. Similarly, the PTC threshold or trigger temperatures of the PTC material can be adjusted or varied between PTC material zones to vary heating across the surface of heater 12. Thus, the PTC materials can be selected to provide a temperature differential across PTC heater 1200, if desired. Areas 1250 bounded by buss bars 1206 and dashed lined representing layers of heater 1200 are areas of constant wattage heating material Referring now to FIG. 13, an approximate equivalent electric circuit for heater 1200 shown in FIGS. 12A-12B is shown. The PTC heater shown in FIGS. 12A and 12B operates according to the operation of the circuit in FIG. 13. Fixed value resistors 1214 represent constant wattage heater layer 1214. Variable value resistor 1212 represent PTC heater layer 1212. Variable resistor 1212 is electrically coupled in parallel with fixed resistor 1214 at selected areas of heater 1200. Variable resistor 1212 is also in electrical series with fixed resistor 1214 at selected areas of heater 1200. A voltage from power source 1212 is applied across the resistors 1212 and 1214 when switch 1204 is in a closed state. The voltage may cause current to flow into the resistors.

In one example, PTC material 1212 or resistors 1212 has a resistance that is much lower that the resistance of constant wattage heater 1214 or resistors 1214 at temperatures below the trigger or threshold temperature of PTC material 1212. For example, PTC material 1212 may have a resistance that is one tenth or less than that of constant wattage heater 1214 at heater temperatures less than the PTC threshold or trigger temperature. Therefore, when heater 1200 is at a temperature lower than the trigger temperature of PTC material 1212, higher thermal output of heater 1200 occurs at heater areas corresponding to resistors 1214 as compared to heater areas corresponding to resistors 1212. In other words, heater 1200 generates more thermal output at each end area 1250 of heater 1200 when a temperature of the heater is less than the PTC heater or trigger temperature. If however, a temperature of heater 1200 reaches the PTC material threshold temperature, resistance of areas of heater 1200 corresponding to variable resistors 1212 may increase by an order of magnitude so that current is restricted through areas of constant wattage heater 1214 corresponding to resistors 1214. Areas 1250 shown in FIG. 12A correspond to resistors at each end of the circuit while areas 1260 correspond to resistors in parallel in the circuit. The variable resistor between groups of parallel resistors corresponds to the area of PTC material 1212 over diagonal gap 1210. If PTC material 1212 comprises several different areas or zones with different PTC material trigger or threshold temperatures, additional control of current flow through or around the constant wattage heater may be provided. In this way, different heating zones with different PTC threshold or trigger temperatures may be provided for a PTC heater. Further, heater 1200 is self temperature and current regulating via PTC material 1212.

In the example of FIGS. 12A and 12B, if PTC coating 1212 is an order of magnitude or more conductive than the constant wattage resistor 1214 the following may be a rough approximation of watt density:

$$Q = \frac{V^2}{(L_1 - L_2)^2 \cdot \rho}$$

Where Q is the watt density, V is the voltage applied to the heater, $L_1$ is distance 1222 of FIG. 12A defining the overall length the heater between buss bars 1206, $L_2$ is distance 1220 of FIG. 12A defining the length of the PTC material 1212, and p is the sheet resistivity in ohms/sq. The heating rate may be greatly increased as the temperature increase and the conductivity of the PTC material approaches the conductivity of the constant wattage material. During such conditions watt density can be expressed via the following equation:

$$Q = \frac{V^2}{(L_1) \cdot \rho}$$

As a result, PTC material 1212 covering diagonal gap 1210 can limit the heater temperature. Of course, variations of heater 1200 may be provided such that the approximate equivalent circuit shown in FIG. 13 may be adjusted to provide a plurality of different heating and temperature response profiles for heater 1200. In other words, circuits of different configurations may be constructed via providing different alternating layers of PTC and constant wattage heating elements.

Figure 14A:
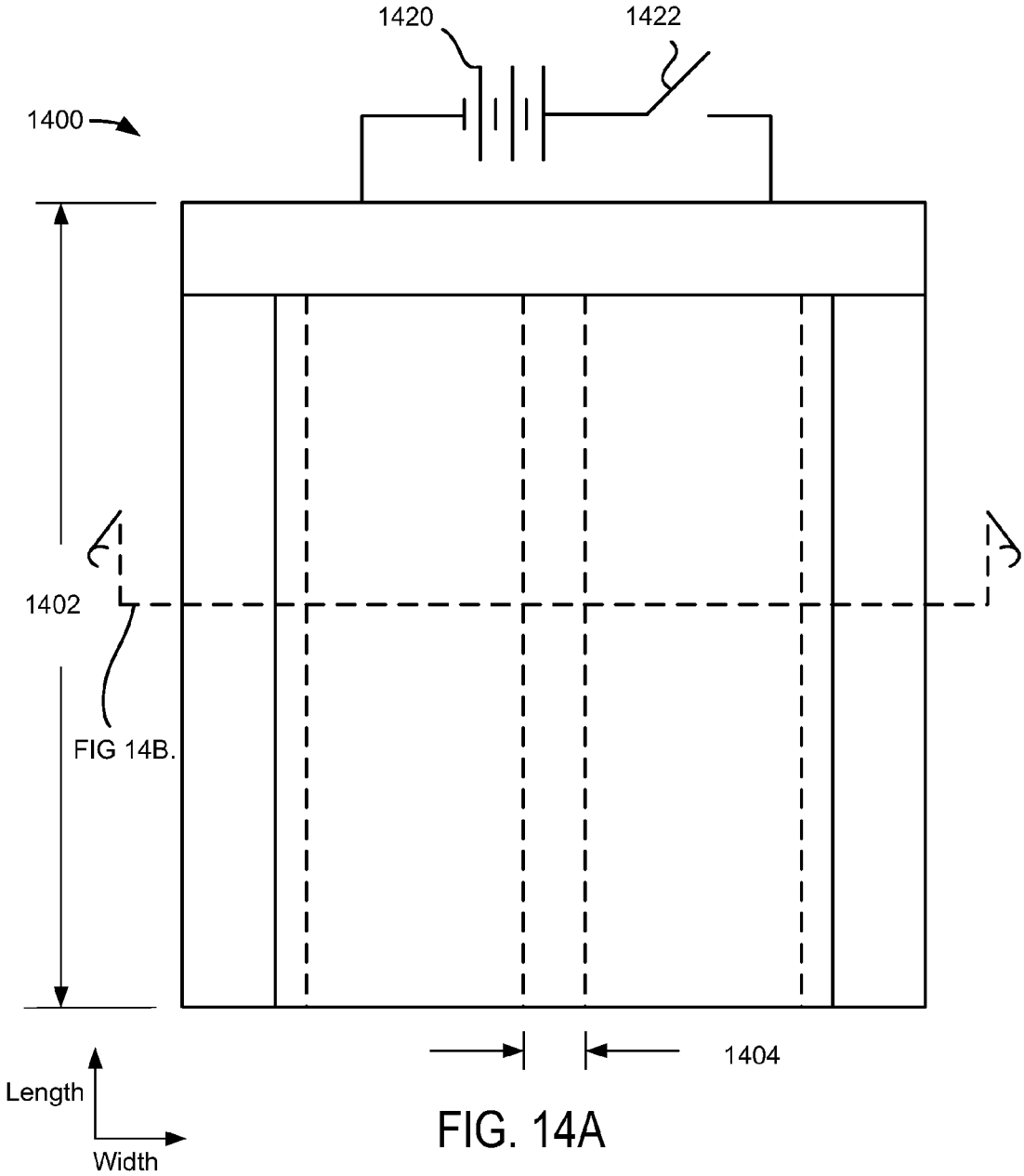
FIG. 14A shows a long thin heater using very thin laminated buss bars coated with a PTC material and then laminated to form current or temperature control device.
Figure 14B:
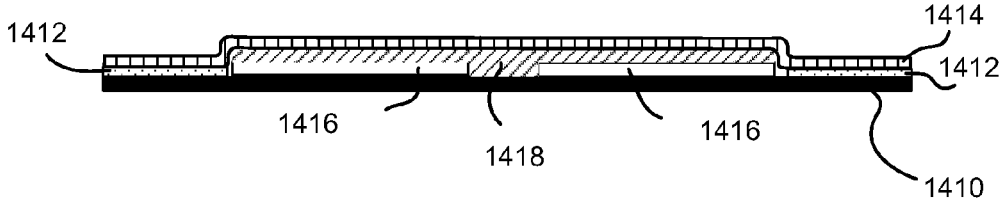
FIG. 14B shows a cross section of the PTC heater device laminated between films to form a protected assembly.

Referring now to FIG. 14, a current limiting assembly 1400 includes a laminated aluminum buss, a coating of PTC material, heat sealing film, and hot melt adhesive. Assembly 1400 may be laminated to constant wattage heaters as shown in FIG. 10 at element 1020. Alternatively, current limiting assembly 1400 can be placed in thermal communication with bearings of an electric motor and in electrical series between an electric motor and a power source as is shown in FIG. 15. Current limiting assembly 1400 may also be applied as a heater/current limiting resettable fuse. FIG. 14A is a plan view of current limiting assembly 1400 and FIG. 14B is a cross section of current limiting assembly 1400 as shown in FIG. 14A.

Current limiting assembly 1400 includes laminated aluminum buss bars 1416. In one example, buss bars may be 0.00035 inch thick foil from Lamart Corporation of 0.001 to 0.003 inch polyester base. Foil may be photo etched. PTC material 1418 may be printed as shown in the cross section of FIG. 14B. Current limiting assembly 1400 may be heat sealed with a film 1414 and hot melt adhesive 1412. Such construction may be suitable for difficult environments.

In one example, where current limiting assembly 1400 is constructed with PTC resistive material having a resistance of 30 ohms/sq. the current limiting capability can be determined. Where it takes about 3 watts/in$^2$ to achieve an 80° C.

temperature rise (e.g., from 20° C. to 100° C.) assuming an ambient 20° C. temperature. Watt density is $$Q = \frac{I^2 R}{A},$$

where I is current in amps, R is resistance, and A is area in square inches. Area can be expressed as A=LW where L is a distance between buss bars and W is the buss bar length. Thus, from the resistivity and watt density equations described above, the current can be determined.

$$R = \rho \frac{L}{W}$$

$$Q = I^2 \rho \frac{L}{WLW}$$

$$Q = \frac{I^2 P}{W^2} \cdot \frac{I^2 \rho}{L^2}$$

$$I = W \sqrt{\frac{Q}{\rho}}$$

The final equation may be expressed as:

$$I = W \sqrt{\frac{Q}{\rho}}$$

Consequently, if the PTC material 1418 is made thick, p of 9 ohms/sq. and W is 4 inches then the current is $$I = 4\sqrt{\frac{3}{9}} = 4\sqrt{0.333} = 2.34 \text{ amps.}$$

W may be increased in length to increase current capacity. And, since the assembly is flexible, it can be rolled and folded to make high current resettable fuses for current protection.

Referring now to FIG. 15A, a current liming device in a system including an electric motor is shown. System 1500 includes electric motor 1502 and bearings 1504 that support rotor 1504. PTC current limiting devices 1540 and 1542 are as described in FIGS. 14A and 14B and are in thermal communication with motor bearings 1510 and 1512. Rotor 1504 is coupled to driveshaft 1506 for driving load 1508. Heat may be generated via bearings 1510 and 1512 when electrical power is applied to electric motor 1502. In one example, PTC current limiting devices 1540 and 1542 are in electrical series with windings of electric motor 1502 as shown and described in FIG. 15B.

Referring now to FIG. 15B, an example electrical circuit for a current limiting device when applied to an electric motor is shown. Electric motor 1502 may rotate when power source 1560 is electrically coupled to electric motor 1502 via switch 1564. Variable resistors 1540 and 1542 represent PTC current limiting devices 1540 and 1542 shown in FIG. 15A. Variable resistors 1540 and 1542 are shown in electrical series with winding 1520 of electrical motor 1502. Winding 1520 may be a rotor or stator winding. PTC current limiting devices 1540 and 1542 exhibit a low resistance level when exposed to temperatures below the trigger temperature of PTC material in the devices. PTC current limiting devices exhibit high resistance when exposed to temperatures above the trigger temperature of PTC material in the devices. PTC current limiting devices 1540 and 1542 restrict current flow from power source 1560 to winding 1520 when a temperature of motor bearings exceeds the trigger temperature of the PTC material. Therefore, the speed of motor 1502 may be reduced so as to lower the thermal load on motor bearings. Consequently, a voltage drop across resistors 1540 and 1542 increases and a voltage drop across electric motor 1502 decreases. If motor bearing temperature remains below the trigger temperature of the PTC material in current limiting devices 1540 and 1542, substantially full voltage of power supply 1560 is applied to electric motor 1502. In this way, PTC current limiting devices may be applied to control motor speed and reduce motor bearing degradation.

Figure 15C:
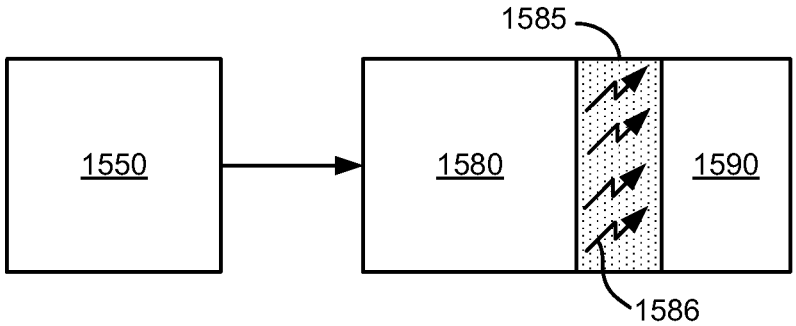
FIG. 15C shows an example system having a heater or other device as described in FIGS. 2-14 may be applied.

Referring now to FIG. 15C, an example system having a heater or other device described herein is shown. Power supply 1550 provides electrical power to heater or current limiting device (e.g., devices shown in FIGS. 2-14) 1580. In one example, device 1580 is a PTC constant wattage heater and device 1580 converts electrical energy supplied by power supply 1550 to thermal energy 1586. PTC constant wattage heater 1580 is in thermal communication with heated area or surface 1590 via dielectric insulator 1585. Current supplied to PTC constant wattage heater is reduced when heated surface 1590 is near a trigger temperature of the PTC material in PTC constant wattage heater 1580.

In other examples, 1580 may be PTC material that limits current flow to load 1590 in response to heating of the PTC material related to current flowing to load 1590. In this way, device 1580 may limit current flow to load 1590 in response to the temperature of load 1590 or the amount of current flowing to load 1590. Load 1590 may be in electrical and thermal communication with device 1580, or alternatively, load 1590 may solely be in electrical communication with device 1580.

Thus, the systems described in FIGS. 2-15 provide for a heater, comprising: a printed or coated PTC material providing a resistance of 20 to 1500 ohms/sq, the resistance increasing three to five orders of magnitude at a threshold temperature, the printed or coated PTC material in thermal communication with a heated area, the resistance of the PTC material responsive to a temperature of the heated area. The heater includes where the printed or coated PTC material is in electrical communication with a first interdigitated buss bar. The heater further comprises a second interdigitated buss bar in electrical communication with a second printed or coated PTC material, the second interdigitated buss bar physically including buss bar fingers that are offset from buss bar fingers of the first interdigitated buss bar, the second interdigitated buss bar in thermal communication with the first interdigitated buss bar. In one example, the heater further comprises a constant resistance heating material in thermal and electrical communication with the printed or coated PTC material. The heater also includes where the printed or coated PTC material and the constant resistance heating material are in an electrical series configuration. The heater also includes where the printed or coated PTC material is at least partially electrically insulated from the constant resistance heating material. In one example, the heater includes where the PTC material and constant resistance heating material are physically coupled along a boundary and gap that is at an angle that is not normal between the PTC material and the constant resistance heating material, and where edges of the constant resistance heating material are rounded. In some examples, the heater includes where the printed or coated PTC material and the constant resistance heating material are in an electrical parallel configuration.

In another example, the systems of FIGS. 2-15 provide for a self regulating heater, comprising: a first heating element with a substantially constant impedance; a first PTC element in electrical and thermal communication with the first heating element, the first PTC element and the first heating element layered to provide series and parallel electrical couplings between the first heating element and the first PTC element. In this way, various combinations of parallel and series electrical circuits may be provided. The self regulating heater also includes where the first PTC element includes a plurality of zones of PTC material, at least two of the plurality of zones including different trigger temperatures. The self regulating heater further comprises a second PTC element in electrical communication and in electrical series with the first heating element and the first PTC element. In one example, the self regulating includes where the first PTC element is also a heater, where the first PTC element is printed or laminated over the first heater and further comprising a dielectric layer between the first PTC element and the first heater. The self regulating heater also includes where the first heating element and the first PTC material are in electrical communication with buss bars common to the first PTC material and the first heating element, the common buss bars of metallic construction.

In still another example, the systems of FIGS. 2-15 provide for a self regulating device, comprising: a constant wattage material providing a first electrical resistance; a PTC material in thermal and electrical communication with the constant wattage material, the PTC material providing a second electrical resistance at a temperature less than a threshold temperature, the PTC material providing a third electrical resistance at a temperature greater than the threshold temperature. In one example, the PTC material and the constant wattage material is applied in layers. Further, the PTC material includes a plurality of zones with different trigger temperatures between the plurality of zones. The PTC and constant wattage material may be in electrical series or parallel. In one example, the PTC material is physically coupled to the constant wattage material alone a boundary that is at an angle that is not normal between the PTC material ant the constant wattage material. In another example, the second electrical resistance is less than the first electrical resistance. In still another example, the third electrical resistance is greater than the first electrical resistance and the constant wattage material is in thermal and electrical communication with the PTC material.

Referring now to FIG. 16, a method for manufacturing or fabricating a PTC constant wattage heater, PTC heater, or PTC current limiting device is shown. Method 1600 applies to devices described in FIGS. 2-15.

At 1602, constant wattage material is deposited to a substrate. In one example, the constant wattage material is carbon based and is electrically conductive. The constant wattage material may be printed or coated on a substrate in rectangular strips or in another geometric shape. In one example, the constant wattage material described in method 1600 is a constant wattage heating material such as a carbon based heating material. Method 1600 proceeds to 1604 after constant wattage material is applied to a substrate.

At 1604, method 1600 judges whether or not the heater includes PTC and constant wattage materials that are to be electrically coupled in parallel. If so, method 1600 proceeds to 1606. Otherwise, the PTC constant wattage device is determined to have solely electrical series connections between PTC and constant wattage materials and proceeds to 1614.

At 1606, method 1600 applies a dielectric material so as to provide a dielectric layer between PTC material and constant wattage material. The dielectric may be sprayed on or applied as a coating. Method 1600 proceeds to 1608 after the dielectric layer is applied to the device.

At 1608, method 1600 applies PTC material in parallel with constant wattage material between common buss bars. For example, PTC material and constant wattage material may be applied in an electrical parallel connection between two buss bars that supply current to the PTC material and the constant wattage material. The PTC material may include several zones comprising different types or PTC material. Further, combination of different types or PTC material and constant wattage materials may be applied to the device. For example, a first PTC material with a trigger temperature of 30° C. and a carbon based constant wattage heating material may be applied in electrical parallel. A second PTC material with a trigger temperature of 40° C. and a second carbon based constant wattage heating material may also be applied in electrical parallel. Thus, a plurality of parallel combinations of different PTC and constant wattage materials may be applied to the device (e.g., See FIG. 8A-8B).

At 1610, method 1600 judges whether or not there are electrical series combinations of PTC and constant wattage materials. If so, method 1600 proceeds to 1614. Otherwise, method 1600 proceeds to 1612.

At 1614, method 1600 applies PTC material in series with constant wattage material between common buss bars. For example, PTC material and constant wattage material may be applied in an electrical series connection between two buss bars that supply current to the PTC material and the constant wattage material. Method 1600 proceeds to 1612 after the PTC material is applied in series with the constant wattage material.

At 1612, method 1600 applies a dielectric layer to cover the PTC and constant wattage materials. The dielectric may protect the PTC and constant wattage materials from material surrounding the device when the device is applied. The dielectric material may be printed, sprayed, or applied as a coating to the PTC and constant wattage materials. Method 1600 exits after the dielectric material is applied to the device.

Referring now to FIG. 17, an example method for operating a PTC constant wattage heater or current limiting device is shown. Method 17 applies to the devices shown in FIGS. 2-15.

At 1702, electrical power is supplied to the electrical heater or current control device. The electric power may be AC or DC power. In some examples, electrical power may be supplied selectively to different portions of a heater so that the heater may provide a plurality of temperatures depending on which heating elements are supplied power and the threshold temperatures of the PTC materials in the individual heating elements of the heater. For example, heating elements of a heater (e.g., see FIG. 4A-4B) that includes a plurality of PTC elements that are electrically isolated or insulated from each other and that include printed or coated PTC material, each of the plurality of PTC elements in electrical coupled to a constant resistance heating element that include constant resistance heating material, can be supplied electrical power at different times to provide different temperatures based on different trigger thresholds of the plurality of PTC elements. Further, in some examples, more than one heating element of heater may be activate at the same time if desired. Method 1700 proceeds to 1704 after power is applied.

At 1704, method 1700 judges whether or not the heater or current control device includes PTC and constant wattage material that is electrically coupled in parallel. If so, method 1700 proceeds to 1706. Otherwise, method 1700 judges that the device is a device solely comprising electrical series couplings.

At 1706, method 1700 allows electrical current to flow through the PTC material based on the resistance of the PTC material. In one example, the PTC material converts electrical energy to thermal energy for heating. Further, the PTC material exhibits a low resistance (e.g., 20 ohms/sq) at temperatures below at trigger temperature of the PTC material. Method 1700 proceeds to 1708 after current begins to flow in the PTC material.

At 1708, method 1700 allows electrical current to flow through the constant wattage material based on the resistance of the constant wattage material. In one example, the constant wattage material converts electrical energy to thermal energy for heating. Further, the resistance of the constant wattage material exhibits little change over a broad temperature range. Method 1700 proceeds to 1710 after current begins to flow in the constant wattage material.

At 1710, method 1700 judges whether or not the PTC material of the PTC device has reached or exceeded the threshold or trigger temperature of the PTC material. If not, method 1700 returns to 1706. If so, method 1700 proceeds to 1712.

At 1712, method adjusts the resistance of the PTC material. In particular, in one example, the resistance of the PTC material is increased by more than three orders of magnitude. When the resistance of the PTC material is increased, current flow through the PTC material can decrease. Method 1700 proceeds to 1714 after the resistance of the PTC material is increased.

At 1714, the thermal output and current flow through the PTC material is reduced. If constant wattage material is in parallel with the PTC material, the current flow through the constant wattage material may be maintained. In one example, the physical properties of the PTC material change so as to reduce current flow through the PTC material. Current flow thought the PTC material may be subsequently increased via cooling the PTC material below the trigger temperature of the PTC material. Method 1700 proceeds to 1716 after the thermal output and the current flow through the PTC material is reduced.

At 1716, method 1700 judges whether or not PTC material is in series with constant wattage material or other PTC material. If so, method 1700 proceeds to 1720. Otherwise, method 1700 proceeds to 1728.

At 1720, equivalent amounts of current flows though PTC and constant wattage heaters that are in electrical series. However, if combinations of parallel and series PTC and constant wattage material are present in the PTC constant wattage device, current flow though PTC and constant wattage materials may be different.

At 1722, method 1700 judges whether or not PTC material has reached a PTC material trigger temperature. If not, method 1700 returns to 1720 where a higher level of current continues to flow though the PTC material. If so, method 1700 proceeds to 1724.

At 1724, method 1700 method adjusts the resistance of the PTC material. When the resistance of the PTC material is increased, current flow through the PTC material and constant wattage material can decreases since the PTC material is electrically in series with the constant wattage material. Method 1700 proceeds to 1726 after the resistance of the PTC material is increased.

At 1726, the thermal output and current flow through the PTC material and constant wattage material is reduced. Depending on the heater or device construction, equivalent or different amounts of current flowing to the PTC and constant wattage heaters may be reduced. Method 1700 proceeds to 1728 after the thermal output and the current flow through the PTC material and constant wattage material is reduced.

At 1728, method 1700 judges whether or not a second PTC material has reached a PTC material trigger temperature. If not, method 1700 exits. If so, method 1700 proceeds to 1730.

At 1730, method 1700 method adjusts the resistance of the second PTC material (e.g., resistor 910 of FIG. 9). When the resistance of the second PTC material is increased, current flow through the second PTC material, the first PTC material, and constant wattage material can decreased when the second PTC material is electrically in series with the first PTC material and the constant wattage material. Method 1700 proceeds to 1732 after the resistance of the second PTC material is increased.

At 1732, the thermal output and current flow through the first PTC material, the second PTC material, and constant wattage material is reduced. Depending on the heater or device construction, equivalent or different amounts of current flowing through the first PTC material, second PTC material, and constant wattage material may be reduced. Method 1700 proceeds to exit after the thermal output and the current flow through the PTC material and constant wattage material is reduced.

Thus, the methods of FIGS. 16 and 17 provide for a method of operating an electrical heater, comprising: in a first mode, providing electrical power to the electrical heater, a first heating element of the electrical heater providing a first thermal output and a second heating element of the electrical heater providing a second thermal output when a temperature of the electrical heater is less than a first threshold temperature; and in a second mode, providing electrical power to the electrical heater, the first heating element of the electrical heater providing a third thermal output and the second heating element of the electrical heater providing the second thermal output when a temperature of the electrical heater is greater than the first threshold temperature, the third thermal output responsive to a change in resistance of the first heating element. In this way, two modes of current control may be passively provided via PTC material. The method further comprises a third element, the third element limiting electrical power to the first heating element and the second heating element when a temperature of the electrical heater is greater than a second threshold temperature. The method also includes where the third element is a PTC element in thermal and electrical communication with the second heating element. The method also includes where the first heating element is a PTC element and the second heating element includes a constant resistance. The method also includes where the first thermal output is greater than the second thermal output. Further, the method includes where the third thermal output is less than the second thermal output. The method also includes where the first threshold temperature is based on a trigger temperature of a PTC material.

The methods of FIGS. 16 and 17 also provide for a method for manufacturing a heater, comprising: applying a constant resistance material to a substrate; applying a PTC material in a layer over the constant resistance material, the PTC in thermal and electrical communication with the constant resistance material. In one example, the method includes where the constant resistance material and the PTC material are in electrical series communication. In another example, the method includes where the constant resistance material and the PTC material are in electrical parallel communication. Further, the method further comprises printing buss bars common to the PTC material and the constant resistance material as part of the heater.

The methods of FIGS. 16 and 17 also provide for operating an electrical heater, comprising: in a first mode, providing a first amount of electrical power to a constant wattage electrical heater via a current regulating device when a temperature of the current regulating device is less than a threshold temperature; and in a second mode, providing a second amount of electrical power to the constant wattage electrical heater via the current regulating device when the temperature of the current regulating device is greater than the threshold temperature, the current regulating device reducing current supplied to the constant wattage heater in response to a temperature of the constant wattage heater sensed via the current regulating device. In some examples, the method includes where the resistance of the current regulating device is less than 20% of a resistance of the constant wattage heater when a temperature of the current regulating device is less than the threshold temperature. Further, the method includes where the current regulating device comprises printed or coated PTC material. The method also includes where the PTC material is in electrical series with the constant wattage heater.

As will be appreciated by one of ordinary skill in the art, the methods described in FIG. 16 may represent one or more of any number of processing strategies. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A heater, comprising:

a printed or coated PTC material providing a resistance of 20 to 1500 ohms/sq, the printed or coated PTC material comprising a sharp melting polymer, the resistance of the printed or coated PTC material increasing three to five orders of magnitude at a threshold temperature corresponding to a melting temperature of the sharp melting polymer, the printed or coated PTC material in thermal communication with a heated area, the resistance of the printed or coated PTC material responsive to a temperature of the heated area; and a constant resistance heating material in contact with and in thermal and series electrical communication with the printed or coated PTC material, the printed or coated PTC material having a length in a direction of electric current flow of 10% or less of a length of the constant resistance heating material, wherein the resistance of the printed or coated PTC material is lower than a resistance of the constant resistance heating material below the threshold temperature such that a majority of a voltage drop during heater use occurs across the constant resistance heating material below the threshold temperature, and wherein the resistance of the printed or coated PTC material is higher than the resistance of the constant resistance heating material above the threshold temperature such that a majority of the voltage drop during heater use occurs across the printed or coated PTC material above the threshold temperature.

2. The heater of claim 1, where the printed or coated PTC material is in electrical communication with a first interdigitated buss bar.

3. The heater of claim 2, wherein the printed or coated PTC material is a first printed or coated PTC material, further comprising a second interdigitated buss bar in electrical communication with a second printed or coated PTC material, the second interdigitated buss bar including buss bar fingers that are offset from buss bar fingers of the first interdigitated buss bar, the second interdigitated buss bar in thermal communication with the first interdigitated buss bar, the constant resistance heating material positioned between the first printed or coated PTC material and the second printed or coated PTC material.

4. The heater of claim 1, where the constant resistance heating material comprises carbon.

5. The heater of claim 1, where the resistance of the printed or coated PTC material is less than 20% of the resistance of the constant resistance heating material when the temperature of the printed or coated PTC material is less than the threshold temperature.

6. The heater of claim 1, where the printed or coated PTC material and the constant resistance heating material are physically coupled along a boundary that is at an oblique angle, and where edges of the constant resistance heating material are rounded, and where the heater includes a plurality of PTC elements that are electrically isolated from each other and that include the printed or coated PTC material, each of the plurality of PTC elements electrically coupled to a constant resistance heating element that includes the constant resistance heating material.

7. The heater of claim 1, where the constant resistance heating material comprises one or more metal vapor sputtered conductors.

8. The heater of claim 1, where the constant resistance heating material is a thermal heating material and converts electrical energy to heat.

9. The heater of claim 1, where the constant resistance heating material supplies substantially constant thermal energy when a constant voltage is applied to the constant resistance heating material.

10. The heater of claim 1, where the printed or coated PTC material and the constant resistance heating material are layered.

11. The heater of claim 1, where the first printed or coated PTC material includes a plurality of zones of PTC material, at least two of the plurality of zones including different trigger temperatures.

12. The heater of claim 1, wherein the printed or coated PTC material is a first printed or coated PTC material, and further comprising a second printed or coated PTC material in electrical communication and in electrical series with the constant resistance heating element and the first printed or coated PTC material.

13. The heater of claim 2, wherein the first interdigitated buss bar is formed from conductive ink.

14. The heater of claim 1, further comprising a dielectric substrate supporting the printed or coated PTC material and the constant resistance heating material.

15. The heater of claim 14, wherein the dielectric substrate comprises glass.

16. The heater of claim 14, further comprising a dielectric coating disposed over the printed or coated PTC material and the constant resistance heating material.

* * * * *